US006473066B1

(12) United States Patent
Okuzono

(10) Patent No.: US 6,473,066 B1
(45) Date of Patent: Oct. 29, 2002

(54) DISPLAY APPARATUS IN WHICH NOISE IS NOT DISPLAYED AS REGULAR PATTERN SINCE AVERAGING OPERATION CAN BE PERFECTLY PERFORMED WHEN INTERLACED SCANNING IS PERFORMED

(75) Inventor: Noboru Okuzono, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/550,875

(22) Filed: Apr. 17, 2000

(30) Foreign Application Priority Data

Apr. 30, 1999 (JP) ..... 11-123881

(51) Int. Cl.[7] ..... G09G 3/36
(52) U.S. Cl. ..... 345/87; 345/214
(58) Field of Search ..... 345/87, 99, 214; 348/742, 792, 793, 556

(56) References Cited

U.S. PATENT DOCUMENTS 5,228,098 A * 7/1993 Crinon et al. ..... 382/56
5,657,034 A * 8/1997 Yamazaki ..... 345/132
6,310,651 B1 * 10/2001 Mizutome ..... 348/459

FOREIGN PATENT DOCUMENTS

JP 4-355788 12/1992

* cited by examiner

*Primary Examiner*—Amare Mengistu

(57) ABSTRACT

A method of driving a display apparatus, includes (a) providing a plurality of processors outputting a plurality of output signals, respectively; (b) providing a plurality of frames, wherein each of the plurality of frames has an averaging pattern for averaging characteristic errors of the plurality of processors and has a plurality of lines; (c) performing a first scanning on a predetermined frame of the plurality of frames such that a predetermined line of the plurality of lines of the predetermined frame is not scanned; and (d) performing a second scanning on a specific frame of the plurality of frames such that a line corresponding to the predetermined line of the specific frame is scanned, the specific frame having a same averaging pattern as the averaging pattern of the predetermined frame.

26 Claims, 29 Drawing Sheets

Fig. 2A PRIOR ART

AVERAGING PATTERN
OF 8H/8V PERIODICITY
FIRST FRAME (FORMAT 1)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 1 | 2 | 3 | 4 | 5 | 6 | 7 | 8 |
| 2 | 3 | 4 | 5 | 6 | 7 | 8 | 1 | 2 |
| 3 | 6 | 7 | 8 | 1 | 2 | 3 | 4 | 5 |
| 4 | 4 | 5 | 6 | 7 | 8 | 1 | 2 | 3 |
| 5 | 8 | 1 | 2 | 3 | 4 | 5 | 6 | 7 |
| 6 | 2 | 3 | 4 | 5 | 6 | 7 | 8 | 1 |
| 7 | 7 | 8 | 1 | 2 | 3 | 4 | 5 | 6 |
| 8 | 5 | 6 | 7 | 8 | 1 | 2 | 3 | 4 |

Fig. 2B PRIOR ART

AVERAGING PATTERN
OF 8H/8V PERIODICITY
SECOND FRAME (FORMAT 2)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 4 | 5 | 6 | 7 | 8 | 1 | 2 | 3 |
| 2 | 6 | 7 | 8 | 1 | 2 | 3 | 4 | 5 |
| 3 | 3 | 4 | 5 | 6 | 7 | 8 | 1 | 2 |
| 4 | 1 | 2 | 3 | 4 | 5 | 6 | 7 | 8 |
| 5 | 5 | 6 | 7 | 8 | 1 | 2 | 3 | 4 |
| 6 | 7 | 8 | 1 | 2 | 3 | 4 | 5 | 6 |
| 7 | 2 | 3 | 4 | 5 | 6 | 7 | 8 | 1 |
| 8 | 8 | 1 | 2 | 3 | 4 | 5 | 6 | 7 |

Fig. 2C PRIOR ART

AVERAGING PATTERN
OF 8H/8V PERIODICITY
THIRD FRAME (FORMAT 3)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 7 | 8 | 1 | 2 | 3 | 4 | 5 | 6 |
| 2 | 5 | 6 | 7 | 8 | 1 | 2 | 3 | 4 |
| 3 | 8 | 1 | 2 | 3 | 4 | 5 | 6 | 7 |
| 4 | 2 | 3 | 4 | 5 | 6 | 7 | 8 | 1 |
| 5 | 6 | 7 | 8 | 1 | 2 | 3 | 4 | 5 |
| 6 | 4 | 5 | 6 | 7 | 8 | 1 | 2 | 3 |
| 7 | 1 | 2 | 3 | 4 | 5 | 6 | 7 | 8 |
| 8 | 3 | 4 | 5 | 6 | 7 | 8 | 1 | 2 |

Fig. 2D PRIOR ART

AVERAGING PATTERN
OF 8H/8V PERIODICITY
FOURTH FRAME (FORMAT 4)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 2 | 3 | 4 | 5 | 6 | 7 | 8 | 1 |
| 2 | 8 | 1 | 2 | 3 | 4 | 5 | 6 | 7 |
| 3 | 5 | 6 | 7 | 8 | 1 | 2 | 3 | 4 |
| 4 | 7 | 8 | 1 | 2 | 3 | 4 | 5 | 6 |
| 5 | 3 | 4 | 5 | 6 | 7 | 8 | 1 | 2 |
| 6 | 1 | 2 | 3 | 4 | 5 | 6 | 7 | 8 |
| 7 | 4 | 5 | 6 | 7 | 8 | 1 | 2 | 3 |
| 8 | 6 | 7 | 8 | 1 | 2 | 3 | 4 | 5 |

Fig. 2E PRIOR ART

AVERAGING PATTERN
OF 8H/8V PERIODICITY
FIFTH FRAME (FORMAT 5)

| VERTICAL DIRECTION | HORIZONTAL DIRECTION 1 | 2 | 3 | 4 | 5 | 6 | 7 | 8 |
|---|---|---|---|---|---|---|---|---|
| 1 | 6 | 7 | 8 | 1 | 2 | 3 | 4 | 5 |
| 2 | 4 | 5 | 6 | 7 | 8 | 1 | 2 | 3 |
| 3 | 1 | 2 | 3 | 4 | 5 | 6 | 7 | 8 |
| 4 | 3 | 4 | 5 | 6 | 7 | 8 | 1 | 2 |
| 5 | 7 | 8 | 1 | 2 | 3 | 4 | 5 | 6 |
| 6 | 5 | 6 | 7 | 8 | 1 | 2 | 3 | 4 |
| 7 | 8 | 1 | 2 | 3 | 4 | 5 | 6 | 7 |
| 8 | 2 | 3 | 4 | 5 | 6 | 7 | 8 | 1 |

Fig. 2F PRIOR ART

AVERAGING PATTERN
OF 8H/8V PERIODICITY
SIXTH FRAME (FORMAT 6)

| VERTICAL DIRECTION | HORIZONTAL DIRECTION 1 | 2 | 3 | 4 | 5 | 6 | 7 | 8 |
|---|---|---|---|---|---|---|---|---|
| 1 | 3 | 4 | 5 | 6 | 7 | 8 | 1 | 2 |
| 2 | 1 | 2 | 3 | 4 | 5 | 6 | 7 | 8 |
| 3 | 4 | 5 | 6 | 7 | 8 | 1 | 2 | 3 |
| 4 | 6 | 7 | 8 | 1 | 2 | 3 | 4 | 5 |
| 5 | 2 | 3 | 4 | 5 | 6 | 7 | 8 | 1 |
| 6 | 8 | 1 | 2 | 3 | 4 | 5 | 6 | 7 |
| 7 | 5 | 6 | 7 | 8 | 1 | 2 | 3 | 4 |
| 8 | 7 | 8 | 1 | 2 | 3 | 4 | 5 | 6 |

Fig. 2G PRIOR ART

AVERAGING PATTERN
OF 8H/8V PERIODICITY
SEVENTH FRAME (FORMAT 7)

| VERTICAL DIRECTION | HORIZONTAL DIRECTION 1 | 2 | 3 | 4 | 5 | 6 | 7 | 8 |
|---|---|---|---|---|---|---|---|---|
| 1 | 8 | 1 | 2 | 3 | 4 | 5 | 6 | 7 |
| 2 | 2 | 3 | 4 | 5 | 6 | 7 | 8 | 1 |
| 3 | 7 | 8 | 1 | 2 | 3 | 4 | 5 | 6 |
| 4 | 5 | 6 | 7 | 8 | 1 | 2 | 3 | 4 |
| 5 | 1 | 2 | 3 | 4 | 5 | 6 | 7 | 8 |
| 6 | 3 | 4 | 5 | 6 | 7 | 8 | 1 | 2 |
| 7 | 6 | 7 | 8 | 1 | 2 | 3 | 4 | 5 |
| 8 | 4 | 5 | 6 | 7 | 8 | 1 | 2 | 3 |

Fig. 2H PRIOR ART

AVERAGING PATTERN
OF 8H/8V PERIODICITY
EIGHTH FRAME (FORMAT 8)

| VERTICAL DIRECTION | HORIZONTAL DIRECTION 1 | 2 | 3 | 4 | 5 | 6 | 7 | 8 |
|---|---|---|---|---|---|---|---|---|
| 1 | 5 | 6 | 7 | 8 | 1 | 2 | 3 | 4 |
| 2 | 7 | 8 | 1 | 2 | 3 | 4 | 5 | 6 |
| 3 | 2 | 3 | 4 | 5 | 6 | 7 | 8 | 1 |
| 4 | 8 | 1 | 2 | 3 | 4 | 5 | 6 | 7 |
| 5 | 4 | 5 | 6 | 7 | 8 | 1 | 2 | 3 |
| 6 | 6 | 7 | 8 | 1 | 2 | 3 | 4 | 5 |
| 7 | 3 | 4 | 5 | 6 | 7 | 8 | 1 | 2 |
| 8 | 1 | 2 | 3 | 4 | 5 | 6 | 7 | 8 |

Fig. 3A PRIOR ART

DISPLAY IMAGE OF AVERAGING PATTERN OF 8H/8V PERIODICITY FIRST FRAME (FORMAT 1)

| LINE \ PIXEL | 1 | 2 | 3 | 4 | 5 | 6 | 7 | 8 | |
|---|---|---|---|---|---|---|---|---|---|
| 1 | 1 | 2 | 3 | 4 | 5 | 6 | 7 | 8 | A |
| 2 | 3 | 4 | 5 | 6 | 7 | 8 | 1 | 2 | B |
| 3 | 6 | 7 | 8 | 1 | 2 | 3 | 4 | 5 | C |
| 4 | 4 | 5 | 6 | 7 | 8 | 1 | 2 | 3 | D |
| 5 | 8 | 1 | 2 | 3 | 4 | 5 | 6 | 7 | E |
| 6 | 2 | 3 | 4 | 5 | 6 | 7 | 8 | 1 | A |
| 7 | 7 | 8 | 1 | 2 | 3 | 4 | 5 | 6 | B |
| 8 | 5 | 6 | 7 | 8 | 1 | 2 | 3 | 4 | C |

Fig. 3B PRIOR ART

DISPLAY IMAGE OF AVERAGING PATTERN OF 8H/8V PERIODICITY SECOND FRAME (FORMAT 2)

| LINE \ PIXEL | 1 | 2 | 3 | 4 | 5 | 6 | 7 | 8 | |
|---|---|---|---|---|---|---|---|---|---|
| 1 | 4 | 5 | 6 | 7 | 8 | 1 | 2 | 3 | A |
| 2 | 6 | 7 | 8 | 1 | 2 | 3 | 4 | 5 | B |
| 3 | 3 | 4 | 5 | 6 | 7 | 8 | 1 | 2 | C |
| 4 | 1 | 2 | 3 | 4 | 5 | 6 | 7 | 8 | D |
| 5 | 5 | 6 | 7 | 8 | 1 | 2 | 3 | 4 | E |
| 6 | 7 | 8 | 1 | 2 | 3 | 4 | 5 | 6 | A |
| 7 | 2 | 3 | 4 | 5 | 6 | 7 | 8 | 1 | B |
| 8 | 8 | 1 | 2 | 3 | 4 | 5 | 6 | 7 | C |

Fig. 3C PRIOR ART

DISPLAY IMAGE OF AVERAGING PATTERN OF 8H/8V PERIODICITY THIRD FRAME (FORMAT 3)

| LINE \ PIXEL | 1 | 2 | 3 | 4 | 5 | 6 | 7 | 8 | |
|---|---|---|---|---|---|---|---|---|---|
| 1 | 7 | 8 | 1 | 2 | 3 | 4 | 5 | 6 | A |
| 2 | 5 | 6 | 7 | 8 | 1 | 2 | 3 | 4 | B |
| 3 | 8 | 1 | 2 | 3 | 4 | 5 | 6 | 7 | C |
| 4 | 2 | 3 | 4 | 5 | 6 | 7 | 8 | 1 | D |
| 5 | 6 | 7 | 8 | 1 | 2 | 3 | 4 | 5 | E |
| 6 | 4 | 5 | 6 | 7 | 8 | 1 | 2 | 3 | A |
| 7 | 1 | 2 | 3 | 4 | 5 | 6 | 7 | 8 | B |
| 8 | 3 | 4 | 5 | 6 | 7 | 8 | 1 | 2 | C |

Fig. 3D PRIOR ART

DISPLAY IMAGE OF AVERAGING PATTERN OF 8H/8V PERIODICITY FOURTH FRAME (FORMAT 4)

| LINE \ PIXEL | 1 | 2 | 3 | 4 | 5 | 6 | 7 | 8 | |
|---|---|---|---|---|---|---|---|---|---|
| 1 | 2 | 3 | 4 | 5 | 6 | 7 | 8 | 1 | A |
| 2 | 8 | 1 | 2 | 3 | 4 | 5 | 6 | 7 | B |
| 3 | 5 | 6 | 7 | 8 | 1 | 2 | 3 | 4 | C |
| 4 | 7 | 8 | 1 | 2 | 3 | 4 | 5 | 6 | D |
| 5 | 3 | 4 | 5 | 6 | 7 | 8 | 1 | 2 | E |
| 6 | 1 | 2 | 3 | 4 | 5 | 6 | 7 | 8 | A |
| 7 | 4 | 5 | 6 | 7 | 8 | 1 | 2 | 3 | B |
| 8 | 6 | 7 | 8 | 1 | 2 | 3 | 4 | 5 | C |

Fig. 3E PRIOR ART

DISPLAY IMAGE OF AVERAGING PATTERN OF 8H/8V PERIODICITY FIFTH FRAME (FORMAT 5)

| LINE \ PIXEL | 1 | 2 | 3 | 4 | 5 | 6 | 7 | 8 | |
|---|---|---|---|---|---|---|---|---|---|
| 1 | 6 | 7 | 8 | 1 | 2 | 3 | 4 | 5 | A |
| 2 | 4 | 5 | 6 | 7 | 8 | 1 | 2 | 3 | B |
| 3 | 1 | 2 | 3 | 4 | 5 | 6 | 7 | 8 | C |
| 4 | 3 | 4 | 5 | 6 | 7 | 8 | 1 | 2 | D |
| 5 | 7 | 8 | 1 | 2 | 3 | 4 | 5 | 6 | E |
| 6 | 5 | 6 | 7 | 8 | 1 | 2 | 3 | 4 | A |
| 7 | 8 | 1 | 2 | 3 | 4 | 5 | 6 | 7 | B |
| 8 | 2 | 3 | 4 | 5 | 6 | 7 | 8 | 1 | C |

Fig. 3F PRIOR ART

DISPLAY IMAGE OF AVERAGING PATTERN OF 8H/8V PERIODICITY SIXTH FRAME (FORMAT 6)

| LINE \ PIXEL | 1 | 2 | 3 | 4 | 5 | 6 | 7 | 8 | |
|---|---|---|---|---|---|---|---|---|---|
| 1 | 3 | 4 | 5 | 6 | 7 | 8 | 1 | 2 | A |
| 2 | 1 | 2 | 3 | 4 | 5 | 6 | 7 | 8 | B |
| 3 | 4 | 5 | 6 | 7 | 8 | 1 | 2 | 3 | C |
| 4 | 6 | 7 | 8 | 1 | 2 | 3 | 4 | 5 | D |
| 5 | 2 | 3 | 4 | 5 | 6 | 7 | 8 | 1 | E |
| 6 | 8 | 1 | 2 | 3 | 4 | 5 | 6 | 7 | A |
| 7 | 5 | 6 | 7 | 8 | 1 | 2 | 3 | 4 | B |
| 8 | 7 | 8 | 1 | 2 | 3 | 4 | 5 | 6 | C |

Fig. 3G PRIOR ART

DISPLAY IMAGE OF AVERAGING PATTERN OF 8H/8V PERIODICITY SEVENTH FRAME (FORMAT 7)

| LINE \ PIXEL | 1 | 2 | 3 | 4 | 5 | 6 | 7 | 8 | |
|---|---|---|---|---|---|---|---|---|---|
| 1 | 8 | 1 | 2 | 3 | 4 | 5 | 6 | 7 | A |
| 2 | 2 | 3 | 4 | 5 | 6 | 7 | 8 | 1 | B |
| 3 | 7 | 8 | 1 | 2 | 3 | 4 | 5 | 6 | C |
| 4 | 5 | 6 | 7 | 8 | 1 | 2 | 3 | 4 | D |
| 5 | 1 | 2 | 3 | 4 | 5 | 6 | 7 | 8 | E |
| 6 | 3 | 4 | 5 | 6 | 7 | 8 | 1 | 2 | A |
| 7 | 6 | 7 | 8 | 1 | 2 | 3 | 4 | 5 | B |
| 8 | 4 | 5 | 6 | 7 | 8 | 1 | 2 | 3 | C |

Fig. 3H PRIOR ART

DISPLAY IMAGE OF AVERAGING PATTERN OF 8H/8V PERIODICITY EIGHTHFRAME (FORMAT 8)

| LINE \ PIXEL | 1 | 2 | 3 | 4 | 5 | 6 | 7 | 8 | |
|---|---|---|---|---|---|---|---|---|---|
| 1 | 5 | 6 | 7 | 8 | 1 | 2 | 3 | 4 | A |
| 2 | 7 | 8 | 1 | 2 | 3 | 4 | 5 | 6 | B |
| 3 | 2 | 3 | 4 | 5 | 6 | 7 | 8 | 1 | C |
| 4 | 8 | 1 | 2 | 3 | 4 | 5 | 6 | 7 | D |
| 5 | 4 | 5 | 6 | 7 | 8 | 1 | 2 | 3 | E |
| 6 | 6 | 7 | 8 | 1 | 2 | 3 | 4 | 5 | A |
| 7 | 3 | 4 | 5 | 6 | 7 | 8 | 1 | 2 | B |
| 8 | 1 | 2 | 3 | 4 | 5 | 6 | 7 | 8 | C |

Fig. 4A PRIOR ART

DISPLAY IMAGE WHEN A 1.6-TIMES ENLARGED DISPLAY IS DONE IN THE AVERAGING PATTERN OF 8H/8V PERIODICITY

FIRST FRAME (FORMAT 1)

| LINE \ PIXEL | 1 | 2 | 3 | 4 | 5 | 6 | 7 | 8 | |
|---|---|---|---|---|---|---|---|---|---|
| 1 | 1 | 2 | 3 | 4 | 5 | 6 | 7 | 8 | A |
| 2 | 1 | 2 | 3 | 4 | 5 | 6 | 7 | 8 | A |
| 3 | 3 | 4 | 5 | 6 | 7 | 8 | 1 | 2 | B |
| 4 | 3 | 4 | 5 | 6 | 7 | 8 | 1 | 2 | B |
| 5 | 6 | 7 | 8 | 1 | 2 | 3 | 4 | 5 | C |
| 6 | 4 | 5 | 6 | 7 | 8 | 1 | 2 | 3 | D |
| 7 | 4 | 5 | 6 | 7 | 8 | 1 | 2 | 3 | D |
| 8 | 8 | 1 | 2 | 3 | 4 | 5 | 6 | 7 | E |
| 9 | 2 | 3 | 4 | 5 | 6 | 7 | 8 | 1 | A |
| 10 | 2 | 3 | 4 | 5 | 6 | 7 | 8 | 1 | A |
| 11 | 7 | 8 | 1 | 2 | 3 | 4 | 5 | 6 | B |
| 12 | 7 | 8 | 1 | 2 | 3 | 4 | 5 | 6 | B |
| 13 | 5 | 6 | 7 | 8 | 1 | 2 | 3 | 4 | C |

Fig. 4B PRIOR ART

DISPLAY IMAGE WHEN A 1.6-TIMES ENLARGED DISPLAY IS DONE IN THE AVERAGING PATTERN OF 8H/8V PERIODICITY

SECOND FRAME (FORMAT 2)

| LINE \ PIXEL | 1 | 2 | 3 | 4 | 5 | 6 | 7 | 8 | |
|---|---|---|---|---|---|---|---|---|---|
| 1 | 4 | 5 | 6 | 7 | 8 | 1 | 2 | 3 | A |
| 2 | 4 | 5 | 6 | 7 | 8 | 1 | 2 | 3 | A |
| 3 | 6 | 7 | 8 | 1 | 2 | 3 | 4 | 5 | B |
| 4 | 6 | 7 | 8 | 1 | 2 | 3 | 4 | 5 | B |
| 5 | 3 | 4 | 5 | 6 | 7 | 8 | 1 | 2 | C |
| 6 | 1 | 2 | 3 | 4 | 5 | 6 | 7 | 8 | D |
| 7 | 1 | 2 | 3 | 4 | 5 | 6 | 7 | 8 | D |
| 8 | 5 | 6 | 7 | 8 | 1 | 2 | 3 | 4 | E |
| 9 | 7 | 8 | 1 | 2 | 3 | 4 | 5 | 6 | A |
| 10 | 7 | 8 | 1 | 2 | 3 | 4 | 5 | 6 | A |
| 11 | 2 | 3 | 4 | 5 | 6 | 7 | 8 | 1 | B |
| 12 | 2 | 3 | 4 | 5 | 6 | 7 | 8 | 1 | B |
| 13 | 8 | 1 | 2 | 3 | 4 | 5 | 6 | 7 | C |

Fig. 4C PRIOR ART

DISPLAY IMAGE WHEN A 1.6-TIMES ENLARGED DISPLAY IS DONE IN THE AVERAGING PATTERN OF 8H/8V PERIODICITY

THIRD FRAME (FORMAT 3)

| LINE \ PIXEL | 1 | 2 | 3 | 4 | 5 | 6 | 7 | 8 | |
|---|---|---|---|---|---|---|---|---|---|
| 1 | 7 | 8 | 1 | 2 | 3 | 4 | 5 | 6 | A |
| 2 | 7 | 8 | 1 | 2 | 3 | 4 | 5 | 6 | A |
| 3 | 5 | 6 | 7 | 8 | 1 | 2 | 3 | 4 | B |
| 4 | 5 | 6 | 7 | 8 | 1 | 2 | 3 | 4 | B |
| 5 | 8 | 1 | 2 | 3 | 4 | 5 | 6 | 7 | C |
| 6 | 2 | 3 | 4 | 5 | 6 | 7 | 8 | 1 | D |
| 7 | 2 | 3 | 4 | 5 | 6 | 7 | 8 | 1 | D |
| 8 | 6 | 7 | 8 | 1 | 2 | 3 | 4 | 5 | E |
| 9 | 4 | 5 | 6 | 7 | 8 | 1 | 2 | 3 | A |
| 10 | 4 | 5 | 6 | 7 | 8 | 1 | 2 | 3 | A |
| 11 | 1 | 2 | 3 | 4 | 5 | 6 | 7 | 8 | B |
| 12 | 1 | 2 | 3 | 4 | 5 | 6 | 7 | 8 | B |
| 13 | 3 | 4 | 5 | 6 | 7 | 8 | 1 | 2 | C |

Fig. 4D PRIOR ART

DISPLAY IMAGE WHEN A 1.6-TIMES ENLARGED DISPLAY IS DONE IN THE AVERAGING PATTERN OF 8H/8V PERIODICITY

FOURTH FRAME (FORMAT 4)

| LINE \ PIXEL | 1 | 2 | 3 | 4 | 5 | 6 | 7 | 8 | |
|---|---|---|---|---|---|---|---|---|---|
| 1 | 2 | 3 | 4 | 5 | 6 | 7 | 8 | 1 | A |
| 2 | 2 | 3 | 4 | 5 | 6 | 7 | 8 | 1 | A |
| 3 | 8 | 1 | 2 | 3 | 4 | 5 | 6 | 7 | B |
| 4 | 8 | 1 | 2 | 3 | 4 | 5 | 6 | 7 | B |
| 5 | 5 | 6 | 7 | 8 | 1 | 2 | 3 | 4 | C |
| 6 | 7 | 8 | 1 | 2 | 3 | 4 | 5 | 6 | D |
| 7 | 7 | 8 | 1 | 2 | 3 | 4 | 5 | 6 | D |
| 8 | 3 | 4 | 5 | 6 | 7 | 8 | 1 | 2 | E |
| 9 | 1 | 2 | 3 | 4 | 5 | 6 | 7 | 8 | A |
| 10 | 1 | 2 | 3 | 4 | 5 | 6 | 7 | 8 | A |
| 11 | 4 | 5 | 6 | 7 | 8 | 1 | 2 | 3 | B |
| 12 | 4 | 5 | 6 | 7 | 8 | 1 | 2 | 3 | B |
| 13 | 6 | 7 | 8 | 1 | 2 | 3 | 4 | 5 | C |

Fig. 4E PRIOR ART

DISPLAY IMAGE WHEN A 1.6-TIMES ENLARGED DISPLAY IS DONE IN THE AVERAGING PATTERN OF 8H/8V PERIODICITY

FIFTH FRAME (FORMAT 5)

| LINE | PIXEL 1 | 2 | 3 | 4 | 5 | 6 | 7 | 8 | |
|---|---|---|---|---|---|---|---|---|---|
| 1 | 6 | 7 | 8 | 1 | 2 | 3 | 4 | 5 | A |
| 2 | 6 | 7 | 8 | 1 | 2 | 3 | 4 | 5 | A |
| 3 | 4 | 5 | 6 | 7 | 8 | 1 | 2 | 3 | B |
| 4 | 4 | 5 | 6 | 7 | 8 | 1 | 2 | 3 | B |
| 5 | 1 | 2 | 3 | 4 | 5 | 6 | 7 | 8 | C |
| 6 | 3 | 4 | 5 | 6 | 7 | 8 | 1 | 2 | D |
| 7 | 3 | 4 | 5 | 6 | 7 | 8 | 1 | 2 | D |
| 8 | 7 | 8 | 1 | 2 | 3 | 4 | 5 | 6 | E |
| 9 | 5 | 6 | 7 | 8 | 1 | 2 | 3 | 4 | A |
| 10 | 5 | 6 | 7 | 8 | 1 | 2 | 3 | 4 | A |
| 11 | 8 | 1 | 2 | 3 | 4 | 5 | 6 | 7 | B |
| 12 | 8 | 1 | 2 | 3 | 4 | 5 | 6 | 7 | B |
| 13 | 2 | 3 | 4 | 5 | 6 | 7 | 8 | 1 | C |

Fig. 4F PRIOR ART

DISPLAY IMAGE WHEN A 1.6-TIMES ENLARGED DISPLAY IS DONE IN THE AVERAGING PATTERN OF 8H/8V PERIODICITY

SIXTH FRAME (FORMAT 6)

| LINE | PIXEL 1 | 2 | 3 | 4 | 5 | 6 | 7 | 8 | |
|---|---|---|---|---|---|---|---|---|---|
| 1 | 3 | 4 | 5 | 6 | 7 | 8 | 1 | 2 | A |
| 2 | 3 | 4 | 5 | 6 | 7 | 8 | 1 | 2 | A |
| 3 | 1 | 2 | 3 | 4 | 5 | 6 | 7 | 8 | B |
| 4 | 1 | 2 | 3 | 4 | 5 | 6 | 7 | 8 | B |
| 5 | 4 | 5 | 6 | 7 | 8 | 1 | 2 | 3 | C |
| 6 | 6 | 7 | 8 | 1 | 2 | 3 | 4 | 5 | D |
| 7 | 6 | 7 | 8 | 1 | 2 | 3 | 4 | 5 | D |
| 8 | 2 | 3 | 4 | 5 | 6 | 7 | 8 | 1 | E |
| 9 | 8 | 1 | 2 | 3 | 4 | 5 | 6 | 7 | A |
| 10 | 8 | 1 | 2 | 3 | 4 | 5 | 6 | 7 | A |
| 11 | 5 | 6 | 7 | 8 | 1 | 2 | 3 | 4 | B |
| 12 | 5 | 6 | 7 | 8 | 1 | 2 | 3 | 4 | B |
| 13 | 7 | 8 | 1 | 2 | 3 | 4 | 5 | 6 | C |

Fig. 4G PRIOR ART

DISPLAY IMAGE WHEN A 1.6-TIMES ENLARGED DISPLAY IS DONE IN THE AVERAGING PATTERN OF 8H/8V PERIODICITY

SEVENTH FRAME (FORMAT 7)

| LINE | PIXEL 1 | 2 | 3 | 4 | 5 | 6 | 7 | 8 | |
|---|---|---|---|---|---|---|---|---|---|
| 1 | 8 | 1 | 2 | 3 | 4 | 5 | 6 | 7 | A |
| 2 | 8 | 1 | 2 | 3 | 4 | 5 | 6 | 7 | A |
| 3 | 2 | 3 | 4 | 5 | 6 | 7 | 8 | 1 | B |
| 4 | 2 | 3 | 4 | 5 | 6 | 7 | 8 | 1 | B |
| 5 | 7 | 8 | 1 | 2 | 3 | 4 | 5 | 6 | C |
| 6 | 5 | 6 | 7 | 8 | 1 | 2 | 3 | 4 | D |
| 7 | 5 | 6 | 7 | 8 | 1 | 2 | 3 | 4 | D |
| 8 | 1 | 2 | 3 | 4 | 5 | 6 | 7 | 8 | E |
| 9 | 3 | 4 | 5 | 6 | 7 | 8 | 1 | 2 | A |
| 10 | 3 | 4 | 5 | 6 | 7 | 8 | 1 | 2 | A |
| 11 | 6 | 7 | 8 | 1 | 2 | 3 | 4 | 5 | B |
| 12 | 6 | 7 | 8 | 1 | 2 | 3 | 4 | 5 | B |
| 13 | 4 | 5 | 6 | 7 | 8 | 1 | 2 | 3 | C |

Fig. 4H PRIOR ART

DISPLAY IMAGE WHEN A 1.6-TIMES ENLARGED DISPLAY IS DONE IN THE AVERAGING PATTERN OF 8H/8V PERIODICITY

EIGHTH FRAME (FORMAT 8)

| LINE | PIXEL 1 | 2 | 3 | 4 | 5 | 6 | 7 | 8 | |
|---|---|---|---|---|---|---|---|---|---|
| 1 | 5 | 6 | 7 | 8 | 1 | 2 | 3 | 4 | A |
| 2 | 5 | 6 | 7 | 8 | 1 | 2 | 3 | 4 | A |
| 3 | 7 | 8 | 1 | 2 | 3 | 4 | 5 | 6 | B |
| 4 | 7 | 8 | 1 | 2 | 3 | 4 | 5 | 6 | B |
| 5 | 2 | 3 | 4 | 5 | 6 | 7 | 8 | 1 | C |
| 6 | 8 | 1 | 2 | 3 | 4 | 5 | 6 | 7 | D |
| 7 | 8 | 1 | 2 | 3 | 4 | 5 | 6 | 7 | D |
| 8 | 4 | 5 | 6 | 7 | 8 | 1 | 2 | 3 | E |
| 9 | 6 | 7 | 8 | 1 | 2 | 3 | 4 | 5 | A |
| 10 | 6 | 7 | 8 | 1 | 2 | 3 | 4 | 5 | A |
| 11 | 3 | 4 | 5 | 6 | 7 | 8 | 1 | 2 | B |
| 12 | 3 | 4 | 5 | 6 | 7 | 8 | 1 | 2 | B |
| 13 | 1 | 2 | 3 | 4 | 5 | 6 | 7 | 8 | C |

Fig. 5A PRIOR ART

DISPLAY IMAGE WHEN A INTERACED SCANNING IS PERFORMED ON THE 1.6-TIMES ENLARGED DISPLAY

FIRST FRAME (FORMAT 1)

| LINE | PIXEL 1 | 2 | 3 | 4 | 5 | 6 | 7 | 8 | |
|---|---|---|---|---|---|---|---|---|---|
| 1 | 1 | 2 | 3 | 4 | 5 | 6 | 7 | 8 | A |
| 2 | 1 | 2 | 3 | 4 | 5 | 6 | 7 | 8 | A |
| 3 | 3 | 4 | 5 | 6 | 7 | 8 | 1 | 2 | B |
| 4 | 3 | 4 | 5 | 6 | 7 | 8 | 1 | 2 | B |
| 5 | 6 | 7 | 8 | 1 | 2 | 3 | 4 | 5 | C |
| 6 | 4 | 5 | 6 | 7 | 8 | 1 | 2 | 3 | D |
| 7 | 4 | 5 | 6 | 7 | 8 | 1 | 2 | 3 | D |
| 8 | 8 | 1 | 2 | 3 | 4 | 5 | 6 | 7 | E |
| 9 | 2 | 3 | 4 | 5 | 6 | 7 | 8 | 1 | A |
| 10 | 2 | 3 | 4 | 5 | 6 | 7 | 8 | 1 | A |
| 11 | 7 | 8 | 1 | 2 | 3 | 4 | 5 | 6 | B |
| 12 | 7 | 8 | 1 | 2 | 3 | 4 | 5 | 6 | B |
| 13 | 5 | 6 | 7 | 8 | 1 | 2 | 3 | 4 | C |

Fig. 5B PRIOR ART

DISPLAY IMAGE WHEN A INTERACED SCANNING IS PERFORMED ON THE 1.6-TIMES ENLARGED DISPLAY

SECOND FRAME (FORMAT 2)

| LINE | PIXEL 1 | 2 | 3 | 4 | 5 | 6 | 7 | 8 | |
|---|---|---|---|---|---|---|---|---|---|
| 1 | 4 | 5 | 6 | 7 | 8 | 1 | 2 | 3 | A |
| 2 | 4 | 5 | 6 | 7 | 8 | 1 | 2 | 3 | A |
| 3 | 6 | 7 | 8 | 1 | 2 | 3 | 4 | 5 | B |
| 4 | 6 | 7 | 8 | 1 | 2 | 3 | 4 | 5 | B |
| 5 | 3 | 4 | 5 | 6 | 7 | 8 | 1 | 2 | C |
| 6 | 1 | 2 | 3 | 4 | 5 | 6 | 7 | 8 | D |
| 7 | 1 | 2 | 3 | 4 | 5 | 6 | 7 | 8 | D |
| 8 | 5 | 6 | 7 | 8 | 1 | 2 | 3 | 4 | E |
| 9 | 7 | 8 | 1 | 2 | 3 | 4 | 5 | 6 | A |
| 10 | 7 | 8 | 1 | 2 | 3 | 4 | 5 | 6 | A |
| 11 | 2 | 3 | 4 | 5 | 6 | 7 | 8 | 1 | B |
| 12 | 2 | 3 | 4 | 5 | 6 | 7 | 8 | 1 | B |
| 13 | 8 | 1 | 2 | 3 | 4 | 5 | 6 | 7 | C |

Fig. 5C PRIOR ART

DISPLAY IMAGE WHEN A INTERACED SCANNING IS PERFORMED ON THE 1.6-TIMES ENLARGED DISPLAY

THIRD FRAME (FORMAT 3)

| LINE | PIXEL 1 | 2 | 3 | 4 | 5 | 6 | 7 | 8 | |
|---|---|---|---|---|---|---|---|---|---|
| 1 | 7 | 8 | 1 | 2 | 3 | 4 | 5 | 6 | A |
| 2 | 7 | 8 | 1 | 2 | 3 | 4 | 5 | 6 | A |
| 3 | 5 | 6 | 7 | 8 | 1 | 2 | 3 | 4 | B |
| 4 | 5 | 6 | 7 | 8 | 1 | 2 | 3 | 4 | B |
| 5 | 8 | 1 | 2 | 3 | 4 | 5 | 6 | 7 | C |
| 6 | 2 | 3 | 4 | 5 | 6 | 7 | 8 | 1 | D |
| 7 | 2 | 3 | 4 | 5 | 6 | 7 | 8 | 1 | D |
| 8 | 6 | 7 | 8 | 1 | 2 | 3 | 4 | 5 | E |
| 9 | 4 | 5 | 6 | 7 | 8 | 1 | 2 | 3 | A |
| 10 | 4 | 5 | 6 | 7 | 8 | 1 | 2 | 3 | A |
| 11 | 1 | 2 | 3 | 4 | 5 | 6 | 7 | 8 | B |
| 12 | 1 | 2 | 3 | 4 | 5 | 6 | 7 | 8 | B |
| 13 | 3 | 4 | 5 | 6 | 7 | 8 | 1 | 2 | C |

Fig. 5D PRIOR ART

DISPLAY IMAGE WHEN A INTERACED SCANNING IS PERFORMED ON THE 1.6-TIMES ENLARGED DISPLAY

FOURTH FRAME (FORMAT 4)

| LINE | PIXEL 1 | 2 | 3 | 4 | 5 | 6 | 7 | 8 | |
|---|---|---|---|---|---|---|---|---|---|
| 1 | 2 | 3 | 4 | 5 | 6 | 7 | 8 | 1 | A |
| 2 | 2 | 3 | 4 | 5 | 6 | 7 | 8 | 1 | A |
| 3 | 8 | 1 | 2 | 3 | 4 | 5 | 6 | 7 | B |
| 4 | 8 | 1 | 2 | 3 | 4 | 5 | 6 | 7 | B |
| 5 | 5 | 6 | 7 | 8 | 1 | 2 | 3 | 4 | C |
| 6 | 7 | 8 | 1 | 2 | 3 | 4 | 5 | 6 | D |
| 7 | 7 | 8 | 1 | 2 | 3 | 4 | 5 | 6 | D |
| 8 | 3 | 4 | 5 | 6 | 7 | 8 | 1 | 2 | E |
| 9 | 1 | 2 | 3 | 4 | 5 | 6 | 7 | 8 | A |
| 10 | 1 | 2 | 3 | 4 | 5 | 6 | 7 | 8 | A |
| 11 | 4 | 5 | 6 | 7 | 8 | 1 | 2 | 3 | B |
| 12 | 4 | 5 | 6 | 7 | 8 | 1 | 2 | 3 | B |
| 13 | 6 | 7 | 8 | 1 | 2 | 3 | 4 | 5 | C |

Fig. 5E PRIOR ART

DISPLAY IMAGE WHEN A INTERACED SCANNING IS PERFORMED ON THE 1.6-TIMES ENLARGED DISPLAY FIFTH FRAME (FORMAT 5)

| LINE | PIXEL 1 | 2 | 3 | 4 | 5 | 6 | 7 | 8 | |
|---|---|---|---|---|---|---|---|---|---|
| 1 | 6 | 7 | 8 | 1 | 2 | 3 | 4 | 5 | A |
| 2 | 6 | 7 | 8 | 1 | 2 | 3 | 4 | 5 | A |
| 3 | 4 | 5 | 6 | 7 | 8 | 1 | 2 | 3 | B |
| 4 | 4 | 5 | 6 | 7 | 8 | 1 | 2 | 3 | B |
| 5 | 1 | 2 | 3 | 4 | 5 | 6 | 7 | 8 | C |
| 6 | 3 | 4 | 5 | 6 | 7 | 8 | 1 | 2 | D |
| 7 | 3 | 4 | 5 | 6 | 7 | 8 | 1 | 2 | D |
| 8 | 7 | 8 | 1 | 2 | 3 | 4 | 5 | 6 | E |
| 9 | 5 | 6 | 7 | 8 | 1 | 2 | 3 | 4 | A |
| 10 | 5 | 6 | 7 | 8 | 1 | 2 | 3 | 4 | A |
| 11 | 8 | 1 | 2 | 3 | 4 | 5 | 6 | 7 | B |
| 12 | 8 | 1 | 2 | 3 | 4 | 5 | 6 | 7 | B |
| 13 | 2 | 3 | 4 | 5 | 6 | 7 | 8 | 1 | C |

Fig. 5F PRIOR ART

DISPLAY IMAGE WHEN A INTERACED SCANNING IS PERFORMED ON THE 1.6-TIMES ENLARGED DISPLAY SIXTH FRAME (FORMAT 6)

| LINE | PIXEL 1 | 2 | 3 | 4 | 5 | 6 | 7 | 8 | |
|---|---|---|---|---|---|---|---|---|---|
| 1 | 3 | 4 | 5 | 6 | 7 | 8 | 1 | 2 | A |
| 2 | 3 | 4 | 5 | 6 | 7 | 8 | 1 | 2 | A |
| 3 | 1 | 2 | 3 | 4 | 5 | 6 | 7 | 8 | B |
| 4 | 1 | 2 | 3 | 4 | 5 | 6 | 7 | 8 | B |
| 5 | 4 | 5 | 6 | 7 | 8 | 1 | 2 | 3 | C |
| 6 | 6 | 7 | 8 | 1 | 2 | 3 | 4 | 5 | D |
| 7 | 6 | 7 | 8 | 1 | 2 | 3 | 4 | 5 | D |
| 8 | 2 | 3 | 4 | 5 | 6 | 7 | 8 | 1 | E |
| 9 | 8 | 1 | 2 | 3 | 4 | 5 | 6 | 7 | A |
| 10 | 8 | 1 | 2 | 3 | 4 | 5 | 6 | 7 | A |
| 11 | 5 | 6 | 7 | 8 | 1 | 2 | 3 | 4 | B |
| 12 | 5 | 6 | 7 | 8 | 1 | 2 | 3 | 4 | B |
| 13 | 7 | 8 | 1 | 2 | 3 | 4 | 5 | 6 | C |

Fig. 5G PRIOR ART

DISPLAY IMAGE WHEN A INTERACED SCANNING IS PERFORMED ON THE 1.6-TIMES ENLARGED DISPLAY SEVENTH FRAME (FORMAT 7)

| LINE | PIXEL 1 | 2 | 3 | 4 | 5 | 6 | 7 | 8 | |
|---|---|---|---|---|---|---|---|---|---|
| 1 | 8 | 1 | 2 | 3 | 4 | 5 | 6 | 7 | A |
| 2 | 8 | 1 | 2 | 3 | 4 | 5 | 6 | 7 | A |
| 3 | 2 | 3 | 4 | 5 | 6 | 7 | 8 | 1 | B |
| 4 | 2 | 3 | 4 | 5 | 6 | 7 | 8 | 1 | B |
| 5 | 7 | 8 | 1 | 2 | 3 | 4 | 5 | 6 | C |
| 6 | 5 | 6 | 7 | 8 | 1 | 2 | 3 | 4 | D |
| 7 | 5 | 6 | 7 | 8 | 1 | 2 | 3 | 4 | D |
| 8 | 1 | 2 | 3 | 4 | 5 | 6 | 7 | 8 | E |
| 9 | 3 | 4 | 5 | 6 | 7 | 8 | 1 | 2 | A |
| 10 | 3 | 4 | 5 | 6 | 7 | 8 | 1 | 2 | A |
| 11 | 6 | 7 | 8 | 1 | 2 | 3 | 4 | 5 | B |
| 12 | 6 | 7 | 8 | 1 | 2 | 3 | 4 | 5 | B |
| 13 | 4 | 5 | 6 | 7 | 8 | 1 | 2 | 3 | C |

Fig. 5H PRIOR ART

DISPLAY IMAGE WHEN A INTERACED SCANNING IS PERFORMED ON THE 1.6-TIMES ENLARGED DISPLAY EIGHTH FRAME (FORMAT 8)

| LINE | PIXEL 1 | 2 | 3 | 4 | 5 | 6 | 7 | 8 | |
|---|---|---|---|---|---|---|---|---|---|
| 1 | 5 | 6 | 7 | 8 | 1 | 2 | 3 | 4 | A |
| 2 | 5 | 6 | 7 | 8 | 1 | 2 | 3 | 4 | A |
| 3 | 7 | 8 | 1 | 2 | 3 | 4 | 5 | 6 | B |
| 4 | 7 | 8 | 1 | 2 | 3 | 4 | 5 | 6 | B |
| 5 | 2 | 3 | 4 | 5 | 6 | 7 | 8 | 1 | C |
| 6 | 8 | 1 | 2 | 3 | 4 | 5 | 6 | 7 | D |
| 7 | 8 | 1 | 2 | 3 | 4 | 5 | 6 | 7 | D |
| 8 | 4 | 5 | 6 | 7 | 8 | 1 | 2 | 3 | E |
| 9 | 6 | 7 | 8 | 1 | 2 | 3 | 4 | 5 | A |
| 10 | 6 | 7 | 8 | 1 | 2 | 3 | 4 | 5 | A |
| 11 | 3 | 4 | 5 | 6 | 7 | 8 | 1 | 2 | B |
| 12 | 3 | 4 | 5 | 6 | 7 | 8 | 1 | 2 | B |
| 13 | 1 | 2 | 3 | 4 | 5 | 6 | 7 | 8 | C |

Fig. 6 PRIOR ART

DISPLAY IMAGE WHEN EIGHT FRAMES ARE OVERLAPPED

| LINE | PIXEL 1 | 2 | 3 | 4 | 5 | 6 | 7 | 8 | |
|---|---|---|---|---|---|---|---|---|---|
| 1 | 1 | 1 | 1 | 1 | | | | | A |
| 2 | | | | | 1 | 1 | 1 | 1 | A |
| 3 | | | | | 1 | 1 | 1 | 1 | B |
| 4 | 1 | 1 | 1 | 1 | | | | | B |
| 5 | 1 | 1 | 1 | 1 | | | | | C |
| 6 | 1 | 1 | 1 | 1 | | | | | D |
| 7 | | | | | 1 | 1 | 1 | 1 | D |
| 8 | | | | | 1 | 1 | 1 | 1 | E |
| 9 | | | | | 1 | 1 | 1 | 1 | A |
| 10 | 1 | 1 | 1 | 1 | | | | | A |
| 11 | 1 | 1 | 1 | 1 | | | | | B |
| 12 | | | | | 1 | 1 | 1 | 1 | B |
| 13 | | | | | 1 | 1 | 1 | 1 | C |

BK

BK

BK

BK

Fig. 8A

AVERAGING PATTERN
OF 8H/16V PERIODICITY
FIRST FRAME (FORMAT 1)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 1 | 2 | 3 | 4 | 5 | 6 | 7 | 8 |
| 2 | 3 | 4 | 5 | 6 | 7 | 8 | 1 | 2 |
| 3 | 6 | 7 | 8 | 1 | 2 | 3 | 4 | 5 |
| 4 | 4 | 5 | 6 | 7 | 8 | 1 | 2 | 3 |
| 5 | 8 | 1 | 2 | 3 | 4 | 5 | 6 | 7 |
| 6 | 2 | 3 | 4 | 5 | 6 | 7 | 8 | 1 |
| 7 | 7 | 8 | 1 | 2 | 3 | 4 | 5 | 6 |
| 8 | 5 | 6 | 7 | 8 | 1 | 2 | 3 | 4 |

Fig. 8B

AVERAGING PATTERN
OF 8H/16V PERIODICITY
SECOND FRAME (FORMAT 1)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 1 | 2 | 3 | 4 | 5 | 6 | 7 | 8 |
| 2 | 3 | 4 | 5 | 6 | 7 | 8 | 1 | 2 |
| 3 | 6 | 7 | 8 | 1 | 2 | 3 | 4 | 5 |
| 4 | 4 | 5 | 6 | 7 | 8 | 1 | 2 | 3 |
| 5 | 8 | 1 | 2 | 3 | 4 | 5 | 6 | 7 |
| 6 | 2 | 3 | 4 | 5 | 6 | 7 | 8 | 1 |
| 7 | 7 | 8 | 1 | 2 | 3 | 4 | 5 | 6 |
| 8 | 5 | 6 | 7 | 8 | 1 | 2 | 3 | 4 |

Fig. 8C

AVERAGING PATTERN
OF 8H/16V PERIODICITY
THIRD FRAME (FORMAT 2)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 4 | 5 | 6 | 7 | 8 | 1 | 2 | 3 |
| 2 | 6 | 7 | 8 | 1 | 2 | 3 | 4 | 5 |
| 3 | 3 | 4 | 5 | 6 | 7 | 8 | 1 | 2 |
| 4 | 1 | 2 | 3 | 4 | 5 | 6 | 7 | 8 |
| 5 | 5 | 6 | 7 | 8 | 1 | 2 | 3 | 4 |
| 6 | 7 | 8 | 1 | 2 | 3 | 4 | 5 | 6 |
| 7 | 2 | 3 | 4 | 5 | 6 | 7 | 8 | 1 |
| 8 | 8 | 1 | 2 | 3 | 4 | 5 | 6 | 7 |

Fig. 8D

AVERAGING PATTERN
OF 8H/16V PERIODICITY
FOURTH FRAME (FORMAT 2)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 4 | 5 | 6 | 7 | 8 | 1 | 2 | 3 |
| 2 | 6 | 7 | 8 | 1 | 2 | 3 | 4 | 5 |
| 3 | 3 | 4 | 5 | 6 | 7 | 8 | 1 | 2 |
| 4 | 1 | 2 | 3 | 4 | 5 | 6 | 7 | 8 |
| 5 | 5 | 6 | 7 | 8 | 1 | 2 | 3 | 4 |
| 6 | 7 | 8 | 1 | 2 | 3 | 4 | 5 | 6 |
| 7 | 2 | 3 | 4 | 5 | 6 | 7 | 8 | 1 |
| 8 | 8 | 1 | 2 | 3 | 4 | 5 | 6 | 7 |

Fig. 8E

AVERAGING PATTERN
OF 8H/16V PERIODICITY
FIFTH FRAME (FORMAT 3)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 7 | 8 | 1 | 2 | 3 | 4 | 5 | 6 |
| 2 | 5 | 6 | 7 | 8 | 1 | 2 | 3 | 4 |
| 3 | 8 | 1 | 2 | 3 | 4 | 5 | 6 | 7 |
| 4 | 2 | 3 | 4 | 5 | 6 | 7 | 8 | 1 |
| 5 | 6 | 7 | 8 | 1 | 2 | 3 | 4 | 5 |
| 6 | 4 | 5 | 6 | 7 | 8 | 1 | 2 | 3 |
| 7 | 1 | 2 | 3 | 4 | 5 | 6 | 7 | 8 |
| 8 | 3 | 4 | 5 | 6 | 7 | 8 | 1 | 2 |

Fig. 8G

AVERAGING PATTERN
OF 8H/16V PERIODICITY
SEVENTH FRAME (FORMAT 4)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 2 | 3 | 4 | 5 | 6 | 7 | 8 | 1 |
| 2 | 8 | 1 | 2 | 3 | 4 | 5 | 6 | 7 |
| 3 | 5 | 6 | 7 | 8 | 1 | 2 | 3 | 4 |
| 4 | 7 | 8 | 1 | 2 | 3 | 4 | 5 | 6 |
| 5 | 3 | 4 | 5 | 6 | 7 | 8 | 1 | 2 |
| 6 | 1 | 2 | 3 | 4 | 5 | 6 | 7 | 8 |
| 7 | 4 | 5 | 6 | 7 | 8 | 1 | 2 | 3 |
| 8 | 6 | 7 | 8 | 1 | 2 | 3 | 4 | 8 |

Fig. 8F

AVERAGING PATTERN
OF 8H/16V PERIODICITY
SIXTH FRAME (FORMAT 3)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 7 | 8 | 1 | 2 | 3 | 4 | 5 | 6 |
| 2 | 5 | 6 | 7 | 8 | 1 | 2 | 3 | 4 |
| 3 | 8 | 1 | 2 | 3 | 4 | 5 | 6 | 7 |
| 4 | 2 | 3 | 4 | 5 | 6 | 7 | 8 | 1 |
| 5 | 6 | 7 | 8 | 1 | 2 | 3 | 4 | 5 |
| 6 | 4 | 5 | 6 | 7 | 8 | 1 | 2 | 3 |
| 7 | 1 | 2 | 3 | 4 | 5 | 6 | 7 | 8 |
| 8 | 3 | 4 | 5 | 6 | 7 | 8 | 1 | 2 |

Fig. 8H

AVERAGING PATTERN
OF 8H/16V PERIODICITY
EIGHTH FRAME (FORMAT 4)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 2 | 3 | 4 | 5 | 6 | 7 | 8 | 1 |
| 2 | 8 | 1 | 2 | 3 | 4 | 5 | 6 | 7 |
| 3 | 5 | 6 | 7 | 8 | 1 | 2 | 3 | 4 |
| 4 | 7 | 8 | 1 | 2 | 3 | 4 | 5 | 6 |
| 5 | 3 | 4 | 5 | 6 | 7 | 8 | 1 | 2 |
| 6 | 1 | 2 | 3 | 4 | 5 | 6 | 7 | 8 |
| 7 | 4 | 5 | 6 | 7 | 8 | 1 | 2 | 3 |
| 8 | 6 | 7 | 8 | 1 | 2 | 3 | 4 | 8 |

Fig. 8I

AVERAGING PATTERN
OF 8H/16V PERIODICITY
NINTH FRAME (FORMAT 5)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 6 | 7 | 8 | 1 | 2 | 3 | 4 | 5 |
| 2 | 4 | 5 | 6 | 7 | 8 | 1 | 2 | 3 |
| 3 | 1 | 2 | 3 | 4 | 5 | 6 | 7 | 8 |
| 4 | 3 | 4 | 5 | 6 | 7 | 8 | 1 | 2 |
| 5 | 7 | 8 | 1 | 2 | 3 | 4 | 5 | 6 |
| 6 | 5 | 6 | 7 | 8 | 1 | 2 | 3 | 4 |
| 7 | 8 | 1 | 2 | 3 | 4 | 5 | 6 | 7 |
| 8 | 2 | 3 | 4 | 5 | 6 | 7 | 8 | 1 |

Fig. 8K

AVERAGING PATTERN
OF 8H/16V PERIODICITY
ELEVENTH FRAME (FORMAT 6)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 3 | 4 | 5 | 6 | 7 | 8 | 1 | 2 |
| 2 | 1 | 2 | 3 | 4 | 5 | 6 | 7 | 8 |
| 3 | 4 | 5 | 6 | 7 | 8 | 1 | 2 | 3 |
| 4 | 6 | 7 | 8 | 1 | 2 | 3 | 4 | 5 |
| 5 | 2 | 3 | 4 | 5 | 6 | 7 | 8 | 1 |
| 6 | 8 | 1 | 2 | 3 | 4 | 5 | 6 | 7 |
| 7 | 5 | 6 | 7 | 8 | 1 | 2 | 3 | 4 |
| 8 | 7 | 8 | 1 | 2 | 3 | 4 | 5 | 6 |

Fig. 8J

AVERAGING PATTERN
OF 8H/16V PERIODICITY
TENTH FRAME (FORMAT 5)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 6 | 7 | 8 | 1 | 2 | 3 | 4 | 5 |
| 2 | 4 | 5 | 6 | 7 | 8 | 1 | 2 | 3 |
| 3 | 1 | 2 | 3 | 4 | 5 | 6 | 7 | 8 |
| 4 | 3 | 4 | 5 | 6 | 7 | 8 | 1 | 2 |
| 5 | 7 | 8 | 1 | 2 | 3 | 4 | 5 | 6 |
| 6 | 5 | 6 | 7 | 8 | 1 | 2 | 3 | 4 |
| 7 | 8 | 1 | 2 | 3 | 4 | 5 | 6 | 7 |
| 8 | 2 | 3 | 4 | 5 | 6 | 7 | 8 | 1 |

Fig. 8L

AVERAGING PATTERN
OF 8H/16V PERIODICITY
TWELFTH FRAME (FORMAT 6)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 3 | 4 | 5 | 6 | 7 | 8 | 1 | 2 |
| 2 | 1 | 2 | 3 | 4 | 5 | 6 | 7 | 8 |
| 3 | 4 | 5 | 6 | 7 | 8 | 1 | 2 | 3 |
| 4 | 6 | 7 | 8 | 1 | 2 | 3 | 4 | 5 |
| 5 | 2 | 3 | 4 | 5 | 6 | 7 | 8 | 1 |
| 6 | 8 | 1 | 2 | 3 | 4 | 5 | 6 | 7 |
| 7 | 5 | 6 | 7 | 8 | 1 | 2 | 3 | 4 |
| 8 | 7 | 8 | 1 | 2 | 3 | 4 | 5 | 6 |

Fig. 8M

AVERAGING PATTERN
OF 8H/16V PERIODICITY
THIRTEENTH FRAME (FORMAT 7)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 8 | 1 | 2 | 3 | 4 | 5 | 6 | 7 |
| 2 | 2 | 3 | 4 | 5 | 6 | 7 | 8 | 1 |
| 3 | 7 | 8 | 1 | 2 | 3 | 4 | 5 | 6 |
| 4 | 5 | 6 | 7 | 8 | 1 | 2 | 3 | 4 |
| 5 | 1 | 2 | 3 | 4 | 5 | 6 | 7 | 8 |
| 6 | 3 | 4 | 5 | 6 | 7 | 8 | 1 | 2 |
| 7 | 6 | 7 | 8 | 1 | 2 | 3 | 4 | 5 |
| 8 | 4 | 5 | 6 | 7 | 8 | 1 | 2 | 3 |

Fig. 8O

AVERAGING PATTERN
OF 8H/16V PERIODICITY
FIFTEENTH FRAME (FORMAT 8)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 5 | 6 | 7 | 8 | 1 | 2 | 3 | 4 |
| 2 | 7 | 8 | 1 | 2 | 3 | 4 | 5 | 6 |
| 3 | 2 | 3 | 4 | 5 | 6 | 7 | 8 | 1 |
| 4 | 8 | 1 | 2 | 3 | 4 | 5 | 6 | 7 |
| 5 | 4 | 5 | 6 | 7 | 8 | 1 | 2 | 3 |
| 6 | 6 | 7 | 8 | 1 | 2 | 3 | 4 | 5 |
| 7 | 3 | 4 | 5 | 6 | 7 | 8 | 1 | 2 |
| 8 | 1 | 2 | 3 | 4 | 5 | 6 | 7 | 8 |

Fig. 8N

AVERAGING PATTERN
OF 8H/16V PERIODICITY
FOURTEENTH FRAME (FORMAT 7)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 8 | 1 | 2 | 3 | 4 | 5 | 6 | 7 |
| 2 | 2 | 3 | 4 | 5 | 6 | 7 | 8 | 1 |
| 3 | 7 | 8 | 1 | 2 | 3 | 4 | 5 | 6 |
| 4 | 5 | 6 | 7 | 8 | 1 | 2 | 3 | 4 |
| 5 | 1 | 2 | 3 | 4 | 5 | 6 | 7 | 8 |
| 6 | 3 | 4 | 5 | 6 | 7 | 8 | 1 | 2 |
| 7 | 6 | 7 | 8 | 1 | 2 | 3 | 4 | 5 |
| 8 | 4 | 5 | 6 | 7 | 8 | 1 | 2 | 3 |

Fig. 8P

AVERAGING PATTERN
OF 8H/16V PERIODICITY
SIXTEENTH FRAME (FORMAT 8)

| VERTICAL DIRECTION \ HORIZONTAL DIRECTION | 1 | 2 | 3 | 4 | 5 | 6 | 7 | 8 |
|---|---|---|---|---|---|---|---|---|
| 1 | 5 | 6 | 7 | 8 | 1 | 2 | 3 | 4 |
| 2 | 7 | 8 | 1 | 2 | 3 | 4 | 5 | 6 |
| 3 | 2 | 3 | 4 | 5 | 6 | 7 | 8 | 1 |
| 4 | 8 | 1 | 2 | 3 | 4 | 5 | 6 | 7 |
| 5 | 4 | 5 | 6 | 7 | 8 | 1 | 2 | 3 |
| 6 | 6 | 7 | 8 | 1 | 2 | 3 | 4 | 5 |
| 7 | 3 | 4 | 5 | 6 | 7 | 8 | 1 | 2 |
| 8 | 1 | 2 | 3 | 4 | 5 | 6 | 7 | 8 |

Fig. 9A

DISPLAY IMAGE OF AVERAGING PATTERN OF 8H/16V PERIODICITY FIRST FRAME (FORMAT 1)

| LINE \ PIXEL | 1 | 2 | 3 | 4 | 5 | 6 | 7 | 8 | |
|---|---|---|---|---|---|---|---|---|---|
| 1 | 1 | 2 | 3 | 4 | 5 | 6 | 7 | 8 | A |
| 2 | 3 | 4 | 5 | 6 | 7 | 8 | 1 | 2 | B |
| 3 | 6 | 7 | 8 | 1 | 2 | 3 | 4 | 5 | C |
| 4 | 4 | 5 | 6 | 7 | 8 | 1 | 2 | 3 | D |
| 5 | 8 | 1 | 2 | 3 | 4 | 5 | 6 | 7 | E |
| 6 | 2 | 3 | 4 | 5 | 6 | 7 | 8 | 1 | A |
| 7 | 7 | 8 | 1 | 2 | 3 | 4 | 5 | 6 | B |
| 8 | 5 | 6 | 7 | 8 | 1 | 2 | 3 | 4 | C |

Fig. 9B

DISPLAY IMAGE OF AVERAGING PATTERN OF 8H/16V PERIODICITY SECOND FRAME (FORMAT 1)

| LINE \ PIXEL | 1 | 2 | 3 | 4 | 5 | 6 | 7 | 8 | |
|---|---|---|---|---|---|---|---|---|---|
| 1 | 1 | 2 | 3 | 4 | 5 | 6 | 7 | 8 | A |
| 2 | 3 | 4 | 5 | 6 | 7 | 8 | 1 | 2 | B |
| 3 | 6 | 7 | 8 | 1 | 2 | 3 | 4 | 5 | C |
| 4 | 4 | 5 | 6 | 7 | 8 | 1 | 2 | 3 | D |
| 5 | 8 | 1 | 2 | 3 | 4 | 5 | 6 | 7 | E |
| 6 | 2 | 3 | 4 | 5 | 6 | 7 | 8 | 1 | A |
| 7 | 7 | 8 | 1 | 2 | 3 | 4 | 5 | 6 | B |
| 8 | 5 | 6 | 7 | 8 | 1 | 2 | 3 | 4 | C |

Fig. 9C

DISPLAY IMAGE OF AVERAGING PATTERN OF 8H/16V PERIODICITY THIRD FRAME (FORMAT 2)

| LINE \ PIXEL | 1 | 2 | 3 | 4 | 5 | 6 | 7 | 8 | |
|---|---|---|---|---|---|---|---|---|---|
| 1 | 4 | 5 | 6 | 7 | 8 | 1 | 2 | 3 | A |
| 2 | 6 | 7 | 8 | 1 | 2 | 3 | 4 | 5 | B |
| 3 | 3 | 4 | 5 | 6 | 7 | 8 | 1 | 2 | C |
| 4 | 1 | 2 | 3 | 4 | 5 | 6 | 7 | 8 | D |
| 5 | 5 | 6 | 7 | 8 | 1 | 2 | 3 | 4 | E |
| 6 | 7 | 8 | 1 | 2 | 3 | 4 | 5 | 6 | A |
| 7 | 2 | 3 | 4 | 5 | 6 | 7 | 8 | 1 | B |
| 8 | 8 | 1 | 2 | 3 | 4 | 5 | 6 | 7 | C |

Fig. 9D

DISPLAY IMAGE OF AVERAGING PATTERN OF 8H/16V PERIODICITY FOURTH FRAME (FORMAT 2)

| LINE \ PIXEL | 1 | 2 | 3 | 4 | 5 | 6 | 7 | 8 | |
|---|---|---|---|---|---|---|---|---|---|
| 1 | 4 | 5 | 6 | 7 | 8 | 1 | 2 | 3 | A |
| 2 | 6 | 7 | 8 | 1 | 2 | 3 | 4 | 5 | B |
| 3 | 3 | 4 | 5 | 6 | 7 | 8 | 1 | 2 | C |
| 4 | 1 | 2 | 3 | 4 | 5 | 6 | 7 | 8 | D |
| 5 | 5 | 6 | 7 | 8 | 1 | 2 | 3 | 4 | E |
| 6 | 7 | 8 | 1 | 2 | 3 | 4 | 5 | 6 | A |
| 7 | 2 | 3 | 4 | 5 | 6 | 7 | 8 | 1 | B |
| 8 | 8 | 1 | 2 | 3 | 4 | 5 | 6 | 7 | C |

Fig. 9E

DISPLAY IMAGE OF AVERAGING PATTERN OF 8H/16V PERIODICITY FIFTH FRAME (FORMAT 3)

| LINE | PIXEL 1 | 2 | 3 | 4 | 5 | 6 | 7 | 8 | |
|---|---|---|---|---|---|---|---|---|---|
| 1 | 7 | 8 | 1 | 2 | 3 | 4 | 5 | 6 | A |
| 2 | 5 | 6 | 7 | 8 | 1 | 2 | 3 | 4 | B |
| 3 | 8 | 1 | 2 | 3 | 4 | 5 | 6 | 7 | C |
| 4 | 2 | 3 | 4 | 5 | 6 | 7 | 8 | 1 | D |
| 5 | 6 | 7 | 8 | 1 | 2 | 3 | 4 | 5 | E |
| 6 | 4 | 5 | 6 | 7 | 8 | 1 | 2 | 3 | A |
| 7 | 1 | 2 | 3 | 4 | 5 | 6 | 7 | 8 | B |
| 8 | 3 | 4 | 5 | 6 | 7 | 8 | 1 | 2 | C |

Fig. 9G

DISPLAY IMAGE OF AVERAGING PATTERN OF 8H/16V PERIODICITY SEVENTH FRAME (FORMAT 4)

| LINE | PIXEL 1 | 2 | 3 | 4 | 5 | 6 | 7 | 8 | |
|---|---|---|---|---|---|---|---|---|---|
| 1 | 2 | 3 | 4 | 5 | 6 | 7 | 8 | 1 | A |
| 2 | 8 | 1 | 2 | 3 | 4 | 5 | 6 | 7 | B |
| 3 | 5 | 6 | 7 | 8 | 1 | 2 | 3 | 4 | C |
| 4 | 7 | 8 | 1 | 2 | 3 | 4 | 5 | 6 | D |
| 5 | 3 | 4 | 5 | 6 | 7 | 8 | 1 | 2 | E |
| 6 | 1 | 2 | 3 | 4 | 5 | 6 | 7 | 8 | A |
| 7 | 4 | 5 | 6 | 7 | 8 | 1 | 2 | 3 | B |
| 8 | 6 | 7 | 8 | 1 | 2 | 3 | 4 | 5 | C |

Fig. 9F

DISPLAY IMAGE OF AVERAGING PATTERN OF 8H/16V PERIODICITY SIXTH FRAME (FORMAT 3)

| LINE | PIXEL 1 | 2 | 3 | 4 | 5 | 6 | 7 | 8 | |
|---|---|---|---|---|---|---|---|---|---|
| 1 | 7 | 8 | 1 | 2 | 3 | 4 | 5 | 6 | A |
| 2 | 5 | 6 | 7 | 8 | 1 | 2 | 3 | 4 | B |
| 3 | 8 | 1 | 2 | 3 | 4 | 5 | 6 | 7 | C |
| 4 | 2 | 3 | 4 | 5 | 6 | 7 | 8 | 1 | D |
| 5 | 6 | 7 | 8 | 1 | 2 | 3 | 4 | 5 | E |
| 6 | 4 | 5 | 6 | 7 | 8 | 1 | 2 | 3 | A |
| 7 | 1 | 2 | 3 | 4 | 5 | 6 | 7 | 8 | B |
| 8 | 3 | 4 | 5 | 6 | 7 | 8 | 1 | 2 | C |

Fig. 9H

DISPLAY IMAGE OF AVERAGING PATTERN OF 8H/16V PERIODICITY EIGHTH FRAME (FORMAT 4)

| LINE | PIXEL 1 | 2 | 3 | 4 | 5 | 6 | 7 | 8 | |
|---|---|---|---|---|---|---|---|---|---|
| 1 | 2 | 3 | 4 | 5 | 6 | 7 | 8 | 1 | A |
| 2 | 8 | 1 | 2 | 3 | 4 | 5 | 6 | 7 | B |
| 3 | 5 | 6 | 7 | 8 | 1 | 2 | 3 | 4 | C |
| 4 | 7 | 8 | 1 | 2 | 3 | 4 | 5 | 6 | D |
| 5 | 3 | 4 | 5 | 6 | 7 | 8 | 1 | 2 | E |
| 6 | 1 | 2 | 3 | 4 | 5 | 6 | 7 | 8 | A |
| 7 | 4 | 5 | 6 | 7 | 8 | 1 | 2 | 3 | B |
| 8 | 6 | 7 | 8 | 1 | 2 | 3 | 4 | 5 | C |

Fig. 9I

DISPLAY IMAGE OF AVERAGING PATTERN OF 8H/16V PERIODICITY NINTH FRAME (FORMAT 5)

| LINE \ PIXEL | 1 | 2 | 3 | 4 | 5 | 6 | 7 | 8 | |
|---|---|---|---|---|---|---|---|---|---|
| 1 | 6 | 7 | 8 | 1 | 2 | 3 | 4 | 5 | A |
| 2 | 4 | 5 | 6 | 7 | 8 | 1 | 2 | 3 | B |
| 3 | 1 | 2 | 3 | 4 | 5 | 6 | 7 | 8 | C |
| 4 | 3 | 4 | 5 | 6 | 7 | 8 | 1 | 2 | D |
| 5 | 7 | 8 | 1 | 2 | 3 | 4 | 5 | 6 | E |
| 6 | 5 | 6 | 7 | 8 | 1 | 2 | 3 | 4 | A |
| 7 | 8 | 1 | 2 | 3 | 4 | 5 | 6 | 7 | B |
| 8 | 2 | 3 | 4 | 5 | 6 | 7 | 8 | 1 | C |

Fig. 9K

DISPLAY IMAGE OF AVERAGING PATTERN OF 8H/16V PERIODICITY ELEVENTH FRAME (FORMAT 6)

| LINE \ PIXEL | 1 | 2 | 3 | 4 | 5 | 6 | 7 | 8 | |
|---|---|---|---|---|---|---|---|---|---|
| 1 | 3 | 4 | 5 | 6 | 7 | 8 | 1 | 2 | A |
| 2 | 1 | 2 | 3 | 4 | 5 | 6 | 7 | 8 | B |
| 3 | 4 | 5 | 6 | 7 | 8 | 1 | 2 | 3 | C |
| 4 | 6 | 7 | 8 | 1 | 2 | 3 | 4 | 5 | D |
| 5 | 2 | 3 | 4 | 5 | 6 | 7 | 8 | 1 | E |
| 6 | 8 | 1 | 2 | 3 | 4 | 5 | 6 | 7 | A |
| 7 | 5 | 6 | 7 | 8 | 1 | 2 | 3 | 4 | B |
| 8 | 7 | 8 | 1 | 2 | 3 | 4 | 5 | 6 | C |

Fig. 9J

DISPLAY IMAGE OF AVERAGING PATTERN OF 8H/16V PERIODICITY TENTH FRAME (FORMAT 5)

| LINE \ PIXEL | 1 | 2 | 3 | 4 | 5 | 6 | 7 | 8 | |
|---|---|---|---|---|---|---|---|---|---|
| 1 | 6 | 7 | 8 | 1 | 2 | 3 | 4 | 5 | A |
| 2 | 4 | 5 | 6 | 7 | 8 | 1 | 2 | 3 | B |
| 3 | 1 | 2 | 3 | 4 | 5 | 6 | 7 | 8 | C |
| 4 | 3 | 4 | 5 | 6 | 7 | 8 | 1 | 2 | D |
| 5 | 7 | 8 | 1 | 2 | 3 | 4 | 5 | 6 | E |
| 6 | 5 | 6 | 7 | 8 | 1 | 2 | 3 | 4 | A |
| 7 | 8 | 1 | 2 | 3 | 4 | 5 | 6 | 7 | B |
| 8 | 2 | 3 | 4 | 5 | 6 | 7 | 8 | 1 | C |

Fig. 9L

DISPLAY IMAGE OF AVERAGING PATTERN OF 8H/16V PERIODICITY TWELFTH FRAME (FORMAT 6)

| LINE \ PIXEL | 1 | 2 | 3 | 4 | 5 | 6 | 7 | 8 | |
|---|---|---|---|---|---|---|---|---|---|
| 1 | 3 | 4 | 5 | 6 | 7 | 8 | 1 | 2 | A |
| 2 | 1 | 2 | 3 | 4 | 5 | 6 | 7 | 8 | B |
| 3 | 4 | 5 | 6 | 7 | 8 | 1 | 2 | 3 | C |
| 4 | 6 | 7 | 8 | 1 | 2 | 3 | 4 | 5 | D |
| 5 | 2 | 3 | 4 | 5 | 6 | 7 | 8 | 1 | E |
| 6 | 8 | 1 | 2 | 3 | 4 | 5 | 6 | 7 | A |
| 7 | 5 | 6 | 7 | 8 | 1 | 2 | 3 | 4 | B |
| 8 | 7 | 8 | 1 | 2 | 3 | 4 | 5 | 6 | C |

Fig. 9M

DISPLAY IMAGE OF AVERAGING PATTERN OF 8H/16V PERIODICITY THIRTEENTH FRAME (FORMAT 7)

| LINE | PIXEL 1 | 2 | 3 | 4 | 5 | 6 | 7 | 8 | |
|---|---|---|---|---|---|---|---|---|---|
| 1 | 8 | 1 | 2 | 3 | 4 | 5 | 6 | 7 | A |
| 2 | 2 | 3 | 4 | 5 | 6 | 7 | 8 | 1 | B |
| 3 | 7 | 8 | 1 | 2 | 3 | 4 | 5 | 6 | C |
| 4 | 5 | 6 | 7 | 8 | 1 | 2 | 3 | 4 | D |
| 5 | 1 | 2 | 3 | 4 | 5 | 6 | 7 | 8 | E |
| 6 | 3 | 4 | 5 | 6 | 7 | 8 | 1 | 2 | A |
| 7 | 6 | 7 | 8 | 1 | 2 | 3 | 4 | 5 | B |
| 8 | 4 | 5 | 6 | 7 | 8 | 1 | 2 | 3 | C |

Fig. 9O

DISPLAY IMAGE OF AVERAGING PATTERN OF 8H/16V PERIODICITY FIFTEENTH FRAME (FORMAT 8)

| LINE | PIXEL 1 | 2 | 3 | 4 | 5 | 6 | 7 | 8 | |
|---|---|---|---|---|---|---|---|---|---|
| 1 | 5 | 6 | 7 | 8 | 1 | 2 | 3 | 4 | A |
| 2 | 7 | 8 | 1 | 2 | 3 | 4 | 5 | 6 | B |
| 3 | 2 | 3 | 4 | 5 | 6 | 7 | 8 | 1 | C |
| 4 | 8 | 1 | 2 | 3 | 4 | 5 | 6 | 7 | D |
| 5 | 4 | 5 | 6 | 7 | 8 | 1 | 2 | 3 | E |
| 6 | 6 | 7 | 8 | 1 | 2 | 3 | 4 | 5 | A |
| 7 | 3 | 4 | 5 | 6 | 7 | 8 | 1 | 2 | B |
| 8 | 1 | 2 | 3 | 4 | 5 | 6 | 7 | 8 | C |

Fig. 9N

DISPLAY IMAGE OF AVERAGING PATTERN OF 8H/16V PERIODICITY FOURTEENTH FRAME (FORMAT 7)

| LINE | PIXEL 1 | 2 | 3 | 4 | 5 | 6 | 7 | 8 | |
|---|---|---|---|---|---|---|---|---|---|
| 1 | 8 | 1 | 2 | 3 | 4 | 5 | 6 | 7 | A |
| 2 | 2 | 3 | 4 | 5 | 6 | 7 | 8 | 1 | B |
| 3 | 7 | 8 | 1 | 2 | 3 | 4 | 5 | 6 | C |
| 4 | 5 | 6 | 7 | 8 | 1 | 2 | 3 | 4 | D |
| 5 | 1 | 2 | 3 | 4 | 5 | 6 | 7 | 8 | E |
| 6 | 3 | 4 | 5 | 6 | 7 | 8 | 1 | 2 | A |
| 7 | 6 | 7 | 8 | 1 | 2 | 3 | 4 | 5 | B |
| 8 | 4 | 5 | 6 | 7 | 8 | 1 | 2 | 3 | C |

Fig. 9P

DISPLAY IMAGE OF AVERAGING PATTERN OF 8H/16V PERIODICITY SIXTEENTH FRAME (FORMAT 8)

| LINE | PIXEL 1 | 2 | 3 | 4 | 5 | 6 | 7 | 8 | |
|---|---|---|---|---|---|---|---|---|---|
| 1 | 5 | 6 | 7 | 8 | 1 | 2 | 3 | 4 | A |
| 2 | 7 | 8 | 1 | 2 | 3 | 4 | 5 | 6 | B |
| 3 | 2 | 3 | 4 | 5 | 6 | 7 | 8 | 1 | C |
| 4 | 8 | 1 | 2 | 3 | 4 | 5 | 6 | 7 | D |
| 5 | 4 | 5 | 6 | 7 | 8 | 1 | 2 | 3 | E |
| 6 | 6 | 7 | 8 | 1 | 2 | 3 | 4 | 5 | A |
| 7 | 3 | 4 | 5 | 6 | 7 | 8 | 1 | 2 | B |
| 8 | 1 | 2 | 3 | 4 | 5 | 6 | 7 | 8 | C |

Fig. 10A

DISPLAY IMAGE WHEN A 1.6-TIMES ENLARGED DISPLAY IS DONE IN THE AVERAGING PATTERN OF 8H/16V PERIODICITY

FIRST FRAME (FORMAT 1)

| LINE | PIXEL 1 | 2 | 3 | 4 | 5 | 6 | 7 | 8 | |
|---|---|---|---|---|---|---|---|---|---|
| 1 | 1 | 2 | 3 | 4 | 5 | 6 | 7 | 8 | A |
| 2 | 1 | 2 | 3 | 4 | 5 | 6 | 7 | 8 | A |
| 3 | 3 | 4 | 5 | 6 | 7 | 8 | 1 | 2 | B |
| 4 | 3 | 4 | 5 | 6 | 7 | 8 | 1 | 2 | B |
| 5 | 6 | 7 | 8 | 1 | 2 | 3 | 4 | 5 | C |
| 6 | 4 | 5 | 6 | 7 | 8 | 1 | 2 | 3 | D |
| 7 | 4 | 5 | 6 | 7 | 8 | 1 | 2 | 3 | D |
| 8 | 8 | 1 | 2 | 3 | 4 | 5 | 6 | 7 | E |
| 9 | 2 | 3 | 4 | 5 | 6 | 7 | 8 | 1 | A |
| 10 | 2 | 3 | 4 | 5 | 6 | 7 | 8 | 1 | A |
| 11 | 7 | 8 | 1 | 2 | 3 | 4 | 5 | 6 | B |
| 12 | 7 | 8 | 1 | 2 | 3 | 4 | 5 | 6 | B |
| 13 | 5 | 6 | 7 | 8 | 1 | 2 | 3 | 4 | C |

Fig. 10B

DISPLAY IMAGE WHEN A 1.6-TIMES ENLARGED DISPLAY IS DONE IN THE AVERAGING PATTERN OF 8H/16V PERIODICITY

SECOND FRAME (FORMAT 1)

| LINE | PIXEL 1 | 2 | 3 | 4 | 5 | 6 | 7 | 8 | |
|---|---|---|---|---|---|---|---|---|---|
| 1 | 1 | 2 | 3 | 4 | 5 | 6 | 7 | 8 | A |
| 2 | 1 | 2 | 3 | 4 | 5 | 6 | 7 | 8 | A |
| 3 | 3 | 4 | 5 | 6 | 7 | 8 | 1 | 2 | B |
| 4 | 3 | 4 | 5 | 6 | 7 | 8 | 1 | 2 | B |
| 5 | 6 | 7 | 8 | 1 | 2 | 3 | 4 | 5 | C |
| 6 | 4 | 5 | 6 | 7 | 8 | 1 | 2 | 3 | D |
| 7 | 4 | 5 | 6 | 7 | 8 | 1 | 2 | 3 | D |
| 8 | 8 | 1 | 2 | 3 | 4 | 5 | 6 | 7 | E |
| 9 | 2 | 3 | 4 | 5 | 6 | 7 | 8 | 1 | A |
| 10 | 2 | 3 | 4 | 5 | 6 | 7 | 8 | 1 | A |
| 11 | 7 | 8 | 1 | 2 | 3 | 4 | 5 | 6 | B |
| 12 | 7 | 8 | 1 | 2 | 3 | 4 | 5 | 6 | B |
| 13 | 5 | 6 | 7 | 8 | 1 | 2 | 3 | 4 | C |

Fig. 10C

DISPLAY IMAGE WHEN A 1.6-TIMES ENLARGED DISPLAY IS DONE IN THE AVERAGING PATTERN OF 8H/16V PERIODICITY

THIRD FRAME (FORMAT 2)

| LINE | PIXEL 1 | 2 | 3 | 4 | 5 | 6 | 7 | 8 | |
|---|---|---|---|---|---|---|---|---|---|
| 1 | 4 | 5 | 6 | 7 | 8 | 1 | 2 | 3 | A |
| 2 | 4 | 5 | 6 | 7 | 8 | 1 | 2 | 3 | A |
| 3 | 6 | 7 | 8 | 1 | 2 | 3 | 4 | 5 | B |
| 4 | 6 | 7 | 8 | 1 | 2 | 3 | 4 | 5 | B |
| 5 | 3 | 4 | 5 | 6 | 7 | 8 | 1 | 2 | C |
| 6 | 1 | 2 | 3 | 4 | 5 | 6 | 7 | 8 | D |
| 7 | 1 | 2 | 3 | 4 | 5 | 6 | 7 | 8 | D |
| 8 | 5 | 6 | 7 | 8 | 1 | 2 | 3 | 4 | E |
| 9 | 7 | 8 | 1 | 2 | 3 | 4 | 5 | 6 | A |
| 10 | 7 | 8 | 1 | 2 | 3 | 4 | 5 | 6 | A |
| 11 | 2 | 3 | 4 | 5 | 6 | 7 | 8 | 1 | B |
| 12 | 2 | 3 | 4 | 5 | 6 | 7 | 8 | 1 | B |
| 13 | 8 | 1 | 2 | 3 | 4 | 5 | 6 | 7 | C |

Fig. 10D

DISPLAY IMAGE WHEN A 1.6-TIMES ENLARGED DISPLAY IS DONE IN THE AVERAGING PATTERN OF 8H/16V PERIODICITY

FOURTH FRAME (FORMAT 2)

| LINE | PIXEL 1 | 2 | 3 | 4 | 5 | 6 | 7 | 8 | |
|---|---|---|---|---|---|---|---|---|---|
| 1 | 4 | 5 | 6 | 7 | 8 | 1 | 2 | 3 | A |
| 2 | 4 | 5 | 6 | 7 | 8 | 1 | 2 | 3 | A |
| 3 | 6 | 7 | 8 | 1 | 2 | 3 | 4 | 5 | B |
| 4 | 6 | 7 | 8 | 1 | 2 | 3 | 4 | 5 | B |
| 5 | 3 | 4 | 5 | 6 | 7 | 8 | 1 | 2 | C |
| 6 | 1 | 2 | 3 | 4 | 5 | 6 | 7 | 8 | D |
| 7 | 1 | 2 | 3 | 4 | 5 | 6 | 7 | 8 | D |
| 8 | 5 | 6 | 7 | 8 | 1 | 2 | 3 | 4 | E |
| 9 | 7 | 8 | 1 | 2 | 3 | 4 | 5 | 6 | A |
| 10 | 7 | 8 | 1 | 2 | 3 | 4 | 5 | 6 | A |
| 11 | 2 | 3 | 4 | 5 | 6 | 7 | 8 | 1 | B |
| 12 | 2 | 3 | 4 | 5 | 6 | 7 | 8 | 1 | B |
| 13 | 8 | 1 | 2 | 3 | 4 | 5 | 6 | 7 | C |

Fig. 10E

DISPLAY IMAGE WHEN A 1.6-TIMES ENLARGED DISPLAY IS DONE IN THE AVERAGING PATTERN OF 8H/16V PERIODICITY

FIFTH FRAME (FORMAT 3)

| LINE | PIXEL 1 | 2 | 3 | 4 | 5 | 6 | 7 | 8 | |
|---|---|---|---|---|---|---|---|---|---|
| 1 | 7 | 8 | 1 | 2 | 3 | 4 | 5 | 6 | A |
| 2 | 7 | 8 | 1 | 2 | 3 | 4 | 5 | 6 | A |
| 3 | 5 | 6 | 7 | 8 | 1 | 2 | 3 | 4 | B |
| 4 | 5 | 6 | 7 | 8 | 1 | 2 | 3 | 4 | B |
| 5 | 8 | 1 | 2 | 3 | 4 | 5 | 6 | 7 | C |
| 6 | 2 | 3 | 4 | 5 | 6 | 7 | 8 | 1 | D |
| 7 | 2 | 3 | 4 | 5 | 6 | 7 | 8 | 1 | D |
| 8 | 6 | 7 | 8 | 1 | 2 | 3 | 4 | 5 | E |
| 9 | 4 | 5 | 6 | 7 | 8 | 1 | 2 | 3 | A |
| 10 | 4 | 5 | 6 | 7 | 8 | 1 | 2 | 3 | A |
| 11 | 1 | 2 | 3 | 4 | 5 | 6 | 7 | 8 | B |
| 12 | 1 | 2 | 3 | 4 | 5 | 6 | 7 | 8 | B |
| 13 | 3 | 4 | 5 | 6 | 7 | 8 | 1 | 2 | C |

Fig. 10F

DISPLAY IMAGE WHEN A 1.6-TIMES ENLARGED DISPLAY IS DONE IN THE AVERAGING PATTERN OF 8H/16V PERIODICITY

SIXTH FRAME (FORMAT 3)

| LINE | PIXEL 1 | 2 | 3 | 4 | 5 | 6 | 7 | 8 | |
|---|---|---|---|---|---|---|---|---|---|
| 1 | 7 | 8 | 1 | 2 | 3 | 4 | 5 | 6 | A |
| 2 | 7 | 8 | 1 | 2 | 3 | 4 | 5 | 6 | A |
| 3 | 5 | 6 | 7 | 8 | 1 | 2 | 3 | 4 | B |
| 4 | 5 | 6 | 7 | 8 | 1 | 2 | 3 | 4 | B |
| 5 | 8 | 1 | 2 | 3 | 4 | 5 | 6 | 7 | C |
| 6 | 2 | 3 | 4 | 5 | 6 | 7 | 8 | 1 | D |
| 7 | 2 | 3 | 4 | 5 | 6 | 7 | 8 | 1 | D |
| 8 | 6 | 7 | 8 | 1 | 2 | 3 | 4 | 5 | E |
| 9 | 4 | 5 | 6 | 7 | 8 | 1 | 2 | 3 | A |
| 10 | 4 | 5 | 6 | 7 | 8 | 1 | 2 | 3 | A |
| 11 | 1 | 2 | 3 | 4 | 5 | 6 | 7 | 8 | B |
| 12 | 1 | 2 | 3 | 4 | 5 | 6 | 7 | 8 | B |
| 13 | 3 | 4 | 5 | 6 | 7 | 8 | 1 | 2 | C |

Fig. 10G

DISPLAY IMAGE WHEN A 1.6-TIMES ENLARGED DISPLAY IS DONE IN THE AVERAGING PATTERN OF 8H/16V PERIODICITY

SEVENTH FRAME (FORMAT 4)

| LINE | PIXEL 1 | 2 | 3 | 4 | 5 | 6 | 7 | 8 | |
|---|---|---|---|---|---|---|---|---|---|
| 1 | 2 | 3 | 4 | 5 | 6 | 7 | 8 | 1 | A |
| 2 | 2 | 3 | 4 | 5 | 6 | 7 | 8 | 1 | A |
| 3 | 8 | 1 | 2 | 3 | 4 | 5 | 6 | 7 | B |
| 4 | 8 | 1 | 2 | 3 | 4 | 5 | 6 | 7 | B |
| 5 | 5 | 6 | 7 | 8 | 1 | 2 | 3 | 4 | C |
| 6 | 7 | 8 | 1 | 2 | 3 | 4 | 5 | 6 | D |
| 7 | 7 | 8 | 1 | 2 | 3 | 4 | 5 | 6 | D |
| 8 | 3 | 4 | 5 | 6 | 7 | 8 | 1 | 2 | E |
| 9 | 1 | 2 | 3 | 4 | 5 | 6 | 7 | 8 | A |
| 10 | 1 | 2 | 3 | 4 | 5 | 6 | 7 | 8 | A |
| 11 | 4 | 5 | 6 | 7 | 8 | 1 | 2 | 3 | B |
| 12 | 4 | 5 | 6 | 7 | 8 | 1 | 2 | 3 | B |
| 13 | 6 | 7 | 8 | 1 | 2 | 3 | 4 | 5 | C |

Fig. 10H

DISPLAY IMAGE WHEN A 1.6-TIMES ENLARGED DISPLAY IS DONE IN THE AVERAGING PATTERN OF 8H/16V PERIODICITY

EIGHTH FRAME (FORMAT 4)

| LINE | PIXEL 1 | 2 | 3 | 4 | 5 | 6 | 7 | 8 | |
|---|---|---|---|---|---|---|---|---|---|
| 1 | 2 | 3 | 4 | 5 | 6 | 7 | 8 | 1 | A |
| 2 | 2 | 3 | 4 | 5 | 6 | 7 | 8 | 1 | A |
| 3 | 8 | 1 | 2 | 3 | 4 | 5 | 6 | 7 | B |
| 4 | 8 | 1 | 2 | 3 | 4 | 5 | 6 | 7 | B |
| 5 | 5 | 6 | 7 | 8 | 1 | 2 | 3 | 4 | C |
| 6 | 7 | 8 | 1 | 2 | 3 | 4 | 5 | 6 | D |
| 7 | 7 | 8 | 1 | 2 | 3 | 4 | 5 | 6 | D |
| 8 | 3 | 4 | 5 | 6 | 7 | 8 | 1 | 2 | E |
| 9 | 1 | 2 | 3 | 4 | 5 | 6 | 7 | 8 | A |
| 10 | 1 | 2 | 3 | 4 | 5 | 6 | 7 | 8 | A |
| 11 | 4 | 5 | 6 | 7 | 8 | 1 | 2 | 3 | B |
| 12 | 4 | 5 | 6 | 7 | 8 | 1 | 2 | 3 | B |
| 13 | 6 | 7 | 8 | 1 | 2 | 3 | 4 | 5 | C |

Fig. 10I

DISPLAY IMAGE WHEN A 1.6-TIMES ENLARGED DISPLAY IS DONE IN THE AVERAGING PATTERN OF 8H/16V PERIODICITY

NINTH FRAME (FORMAT 5)

| LINE \ PIXEL | 1 | 2 | 3 | 4 | 5 | 6 | 7 | 8 | |
|---|---|---|---|---|---|---|---|---|---|
| 1 | 6 | 7 | 8 | 1 | 2 | 3 | 4 | 5 | A |
| 2 | 6 | 7 | 8 | 1 | 2 | 3 | 4 | 5 | A |
| 3 | 4 | 5 | 6 | 7 | 8 | 1 | 2 | 3 | B |
| 4 | 4 | 5 | 6 | 7 | 8 | 1 | 2 | 3 | B |
| 5 | 1 | 2 | 3 | 4 | 5 | 6 | 7 | 8 | C |
| 6 | 3 | 4 | 5 | 6 | 7 | 8 | 1 | 2 | D |
| 7 | 3 | 4 | 5 | 6 | 7 | 8 | 1 | 2 | D |
| 8 | 7 | 8 | 1 | 2 | 3 | 4 | 5 | 6 | E |
| 9 | 5 | 6 | 7 | 8 | 1 | 2 | 3 | 4 | A |
| 10 | 5 | 6 | 7 | 8 | 1 | 2 | 3 | 4 | A |
| 11 | 8 | 1 | 2 | 3 | 4 | 5 | 6 | 7 | B |
| 12 | 8 | 1 | 2 | 3 | 4 | 5 | 6 | 7 | B |
| 13 | 2 | 3 | 4 | 5 | 6 | 7 | 8 | 1 | C |

Fig. 10K

DISPLAY IMAGE WHEN A 1.6-TIMES ENLARGED DISPLAY IS DONE IN THE AVERAGING PATTERN OF 8H/16V PERIODICITY

ELEVENTH FRAME (FORMAT 6)

| LINE \ PIXEL | 1 | 2 | 3 | 4 | 5 | 6 | 7 | 8 | |
|---|---|---|---|---|---|---|---|---|---|
| 1 | 3 | 4 | 5 | 6 | 7 | 8 | 1 | 2 | A |
| 2 | 3 | 4 | 5 | 6 | 7 | 8 | 1 | 2 | A |
| 3 | 1 | 2 | 3 | 4 | 5 | 6 | 7 | 8 | B |
| 4 | 1 | 2 | 3 | 4 | 5 | 6 | 7 | 8 | B |
| 5 | 4 | 5 | 6 | 7 | 8 | 1 | 2 | 3 | C |
| 6 | 6 | 7 | 8 | 1 | 2 | 3 | 4 | 5 | D |
| 7 | 6 | 7 | 8 | 1 | 2 | 3 | 4 | 5 | D |
| 8 | 2 | 3 | 4 | 5 | 6 | 7 | 8 | 1 | E |
| 9 | 8 | 1 | 2 | 3 | 4 | 5 | 6 | 7 | A |
| 10 | 8 | 1 | 2 | 3 | 4 | 5 | 6 | 7 | A |
| 11 | 5 | 6 | 7 | 8 | 1 | 2 | 3 | 4 | B |
| 12 | 5 | 6 | 7 | 8 | 1 | 2 | 3 | 4 | B |
| 13 | 7 | 8 | 1 | 2 | 3 | 4 | 5 | 6 | C |

Fig. 10J

DISPLAY IMAGE WHEN A 1.6-TIMES ENLARGED DISPLAY IS DONE IN THE AVERAGING PATTERN OF 8H/16V PERIODICITY

TENTH FRAME (FORMAT 5)

| LINE \ PIXEL | 1 | 2 | 3 | 4 | 5 | 6 | 7 | 8 | |
|---|---|---|---|---|---|---|---|---|---|
| 1 | 6 | 7 | 8 | 1 | 2 | 3 | 4 | 5 | A |
| 2 | 6 | 7 | 8 | 1 | 2 | 3 | 4 | 5 | A |
| 3 | 4 | 5 | 6 | 7 | 8 | 1 | 2 | 3 | B |
| 4 | 4 | 5 | 6 | 7 | 8 | 1 | 2 | 3 | B |
| 5 | 1 | 2 | 3 | 4 | 5 | 6 | 7 | 8 | C |
| 6 | 3 | 4 | 5 | 6 | 7 | 8 | 1 | 2 | D |
| 7 | 3 | 4 | 5 | 6 | 7 | 8 | 1 | 2 | D |
| 8 | 7 | 8 | 1 | 2 | 3 | 4 | 5 | 6 | E |
| 9 | 5 | 6 | 7 | 8 | 1 | 2 | 3 | 4 | A |
| 10 | 5 | 6 | 7 | 8 | 1 | 2 | 3 | 4 | A |
| 11 | 8 | 1 | 2 | 3 | 4 | 5 | 6 | 7 | B |
| 12 | 8 | 1 | 2 | 3 | 4 | 5 | 6 | 7 | B |
| 13 | 2 | 3 | 4 | 5 | 6 | 7 | 8 | 1 | C |

Fig. 10L

DISPLAY IMAGE WHEN A 1.6-TIMES ENLARGED DISPLAY IS DONE IN THE AVERAGING PATTERN OF 8H/16V PERIODICITY

TWELFTH FRAME (FORMAT 6)

| LINE \ PIXEL | 1 | 2 | 3 | 4 | 5 | 6 | 7 | 8 | |
|---|---|---|---|---|---|---|---|---|---|
| 1 | 3 | 4 | 5 | 6 | 7 | 8 | 1 | 2 | A |
| 2 | 3 | 4 | 5 | 6 | 7 | 8 | 1 | 2 | A |
| 3 | 1 | 2 | 3 | 4 | 5 | 6 | 7 | 8 | B |
| 4 | 1 | 2 | 3 | 4 | 5 | 6 | 7 | 8 | B |
| 5 | 4 | 5 | 6 | 7 | 8 | 1 | 2 | 3 | C |
| 6 | 6 | 7 | 8 | 1 | 2 | 3 | 4 | 5 | D |
| 7 | 6 | 7 | 8 | 1 | 2 | 3 | 4 | 5 | D |
| 8 | 2 | 3 | 4 | 5 | 6 | 7 | 8 | 1 | E |
| 9 | 8 | 1 | 2 | 3 | 4 | 5 | 6 | 7 | A |
| 10 | 8 | 1 | 2 | 3 | 4 | 5 | 6 | 7 | A |
| 11 | 5 | 6 | 7 | 8 | 1 | 2 | 3 | 4 | B |
| 12 | 5 | 6 | 7 | 8 | 1 | 2 | 3 | 4 | B |
| 13 | 7 | 8 | 1 | 2 | 3 | 4 | 5 | 6 | C |

Fig. 10M

DISPLAY IMAGE WHEN A 1.6-TIMES ENLARGED DISPLAY IS DONE IN THE AVERAGING PATTERN OF 8H/16V PERIODICITY

NINTH FRAME (FORMAT 7)

| LINE | PIXEL 1 | 2 | 3 | 4 | 5 | 6 | 7 | 8 | |
|---|---|---|---|---|---|---|---|---|---|
| 1 | 8 | 1 | 2 | 3 | 4 | 5 | 6 | 7 | A |
| 2 | 8 | 1 | 2 | 3 | 4 | 5 | 6 | 7 | A |
| 3 | 2 | 3 | 4 | 5 | 6 | 7 | 8 | 1 | B |
| 4 | 2 | 3 | 4 | 5 | 6 | 7 | 8 | 1 | B |
| 5 | 7 | 8 | 1 | 2 | 3 | 4 | 5 | 6 | C |
| 6 | 5 | 6 | 7 | 8 | 1 | 2 | 3 | 4 | D |
| 7 | 5 | 6 | 7 | 8 | 1 | 2 | 3 | 4 | D |
| 8 | 1 | 2 | 3 | 4 | 5 | 6 | 7 | 8 | E |
| 9 | 3 | 4 | 5 | 6 | 7 | 8 | 1 | 2 | A |
| 10 | 3 | 4 | 5 | 6 | 7 | 8 | 1 | 2 | A |
| 11 | 6 | 7 | 8 | 1 | 2 | 3 | 4 | 5 | B |
| 12 | 6 | 7 | 8 | 1 | 2 | 3 | 4 | 5 | B |
| 13 | 4 | 5 | 6 | 7 | 8 | 1 | 2 | 3 | C |

Fig. 10O

DISPLAY IMAGE WHEN A 1.6-TIMES ENLARGED DISPLAY IS DONE IN THE AVERAGING PATTERN OF 8H/16V PERIODICITY

ELEVENTH FRAME (FORMAT 8)

| LINE | PIXEL 1 | 2 | 3 | 4 | 5 | 6 | 7 | 8 | |
|---|---|---|---|---|---|---|---|---|---|
| 1 | 5 | 6 | 7 | 8 | 1 | 2 | 3 | 4 | A |
| 2 | 5 | 6 | 7 | 8 | 1 | 2 | 3 | 4 | A |
| 3 | 7 | 8 | 1 | 2 | 3 | 4 | 5 | 6 | B |
| 4 | 7 | 8 | 1 | 2 | 3 | 4 | 5 | 6 | B |
| 5 | 2 | 3 | 4 | 5 | 6 | 7 | 8 | 1 | C |
| 6 | 8 | 1 | 2 | 3 | 4 | 5 | 6 | 7 | D |
| 7 | 8 | 1 | 2 | 3 | 4 | 5 | 6 | 7 | D |
| 8 | 4 | 5 | 6 | 7 | 8 | 1 | 2 | 3 | E |
| 9 | 6 | 7 | 8 | 1 | 2 | 3 | 4 | 5 | A |
| 10 | 6 | 7 | 8 | 1 | 2 | 3 | 4 | 5 | A |
| 11 | 3 | 4 | 5 | 6 | 7 | 8 | 1 | 2 | B |
| 12 | 3 | 4 | 5 | 6 | 7 | 8 | 1 | 2 | B |
| 13 | 1 | 2 | 3 | 4 | 5 | 6 | 7 | 8 | C |

Fig. 10N

DISPLAY IMAGE WHEN A 1.6-TIMES ENLARGED DISPLAY IS DONE IN THE AVERAGING PATTERN OF 8H/16V PERIODICITY

TENTH FRAME (FORMAT 7)

| LINE | PIXEL 1 | 2 | 3 | 4 | 5 | 6 | 7 | 8 | |
|---|---|---|---|---|---|---|---|---|---|
| 1 | 8 | 1 | 2 | 3 | 4 | 5 | 6 | 7 | A |
| 2 | 8 | 1 | 2 | 3 | 4 | 5 | 6 | 7 | A |
| 3 | 2 | 3 | 4 | 5 | 6 | 7 | 8 | 1 | B |
| 4 | 2 | 3 | 4 | 5 | 6 | 7 | 8 | 1 | B |
| 5 | 7 | 8 | 1 | 2 | 3 | 4 | 5 | 6 | C |
| 6 | 5 | 6 | 7 | 8 | 1 | 2 | 3 | 4 | D |
| 7 | 5 | 6 | 7 | 8 | 1 | 2 | 3 | 4 | D |
| 8 | 1 | 2 | 3 | 4 | 5 | 6 | 7 | 8 | E |
| 9 | 3 | 4 | 5 | 6 | 7 | 8 | 1 | 2 | A |
| 10 | 3 | 4 | 5 | 6 | 7 | 8 | 1 | 2 | A |
| 11 | 6 | 7 | 8 | 1 | 2 | 3 | 4 | 5 | B |
| 12 | 6 | 7 | 8 | 1 | 2 | 3 | 4 | 5 | B |
| 13 | 4 | 5 | 6 | 7 | 8 | 1 | 2 | 3 | C |

Fig. 10P

DISPLAY IMAGE WHEN A 1.6-TIMES ENLARGED DISPLAY IS DONE IN THE AVERAGING PATTERN OF 8H/16V PERIODICITY

TWELFTH FRAME (FORMAT 8)

| LINE | PIXEL 1 | 2 | 3 | 4 | 5 | 6 | 7 | 8 | |
|---|---|---|---|---|---|---|---|---|---|
| 1 | 5 | 6 | 7 | 8 | 1 | 2 | 3 | 4 | A |
| 2 | 5 | 6 | 7 | 8 | 1 | 2 | 3 | 4 | A |
| 3 | 7 | 8 | 1 | 2 | 3 | 4 | 5 | 6 | B |
| 4 | 7 | 8 | 1 | 2 | 3 | 4 | 5 | 6 | B |
| 5 | 2 | 3 | 4 | 5 | 6 | 7 | 8 | 1 | C |
| 6 | 8 | 1 | 2 | 3 | 4 | 5 | 6 | 7 | D |
| 7 | 8 | 1 | 2 | 3 | 4 | 5 | 6 | 7 | D |
| 8 | 4 | 5 | 6 | 7 | 8 | 1 | 2 | 3 | E |
| 9 | 6 | 7 | 8 | 1 | 2 | 3 | 4 | 5 | A |
| 10 | 6 | 7 | 8 | 1 | 2 | 3 | 4 | 5 | A |
| 11 | 3 | 4 | 5 | 6 | 7 | 8 | 1 | 2 | B |
| 12 | 3 | 4 | 5 | 6 | 7 | 8 | 1 | 2 | B |
| 13 | 1 | 2 | 3 | 4 | 5 | 6 | 7 | 8 | C |

Fig. 11A

DISPLAY IMAGE WHEN EIGHT FRAMES ARE OVERLAPPED
FIRST FRAME (FORMAT 1)

| LINE | PIXEL 1 | 2 | 3 | 4 | 5 | 6 | 7 | 8 | |
|---|---|---|---|---|---|---|---|---|---|
| 1 | 1 | 2 | 3 | 4 | 5 | 6 | 7 | 8 | A |
| 2 | 1 | 2 | 3 | 4 | 5 | 6 | 7 | 8 | A |
| 3 | 3 | 4 | 5 | 6 | 7 | 8 | 1 | 2 | B |
| 4 | 3 | 4 | 5 | 6 | 7 | 8 | 1 | 2 | B |
| 5 | 6 | 7 | 8 | 1 | 2 | 3 | 4 | 5 | C |
| 6 | 4 | 5 | 6 | 7 | 8 | 1 | 2 | 3 | D |
| 7 | 4 | 5 | 6 | 7 | 8 | 1 | 2 | 3 | D |
| 8 | 8 | 1 | 2 | 3 | 4 | 5 | 6 | 7 | E |
| 9 | 2 | 3 | 4 | 5 | 6 | 7 | 8 | 1 | A |
| 10 | 2 | 3 | 4 | 5 | 6 | 7 | 8 | 1 | A |
| 11 | 7 | 8 | 1 | 2 | 3 | 4 | 5 | 6 | B |
| 12 | 7 | 8 | 1 | 2 | 3 | 4 | 5 | 6 | B |
| 13 | 5 | 6 | 7 | 8 | 1 | 2 | 3 | 4 | C |

Fig. 11C

DISPLAY IMAGE WHEN EIGHT FRAMES ARE OVERLAPPED
THIRD FRAME (FORMAT 2)

| LINE | PIXEL 1 | 2 | 3 | 4 | 5 | 6 | 7 | 8 | |
|---|---|---|---|---|---|---|---|---|---|
| 1 | 4 | 5 | 6 | 7 | 8 | 1 | 2 | 3 | A |
| 2 | 4 | 5 | 6 | 7 | 8 | 1 | 2 | 3 | A |
| 3 | 6 | 7 | 8 | 1 | 2 | 3 | 4 | 5 | B |
| 4 | 6 | 7 | 8 | 1 | 2 | 3 | 4 | 5 | B |
| 5 | 3 | 4 | 5 | 6 | 7 | 8 | 1 | 2 | C |
| 6 | 1 | 2 | 3 | 4 | 5 | 6 | 7 | 8 | D |
| 7 | 1 | 2 | 3 | 4 | 5 | 6 | 7 | 8 | D |
| 8 | 5 | 6 | 7 | 8 | 1 | 2 | 3 | 4 | E |
| 9 | 7 | 8 | 1 | 2 | 3 | 4 | 5 | 6 | A |
| 10 | 7 | 8 | 1 | 2 | 3 | 4 | 5 | 6 | A |
| 11 | 2 | 3 | 4 | 5 | 6 | 7 | 8 | 1 | B |
| 12 | 2 | 3 | 4 | 5 | 6 | 7 | 8 | 1 | B |
| 13 | 8 | 1 | 2 | 3 | 4 | 5 | 6 | 7 | C |

Fig. 11B

DISPLAY IMAGE WHEN EIGHT FRAMES ARE OVERLAPPED
SECOND FRAME (FORMAT 1)

| LINE | PIXEL 1 | 2 | 3 | 4 | 5 | 6 | 7 | 8 | |
|---|---|---|---|---|---|---|---|---|---|
| 1 | 1 | 2 | 3 | 4 | 5 | 6 | 7 | 8 | A |
| 2 | 1 | 2 | 3 | 4 | 5 | 6 | 7 | 8 | A |
| 3 | 3 | 4 | 5 | 6 | 7 | 8 | 1 | 2 | B |
| 4 | 3 | 4 | 5 | 6 | 7 | 8 | 1 | 2 | B |
| 5 | 6 | 7 | 8 | 1 | 2 | 3 | 4 | 5 | C |
| 6 | 4 | 5 | 6 | 7 | 8 | 1 | 2 | 3 | D |
| 7 | 4 | 5 | 6 | 7 | 8 | 1 | 2 | 3 | D |
| 8 | 8 | 1 | 2 | 3 | 4 | 5 | 6 | 7 | E |
| 9 | 2 | 3 | 4 | 5 | 6 | 7 | 8 | 1 | A |
| 10 | 2 | 3 | 4 | 5 | 6 | 7 | 8 | 1 | A |
| 11 | 7 | 8 | 1 | 2 | 3 | 4 | 5 | 6 | B |
| 12 | 7 | 8 | 1 | 2 | 3 | 4 | 5 | 6 | B |
| 13 | 5 | 6 | 7 | 8 | 1 | 2 | 3 | 4 | C |

Fig. 11D

DISPLAY IMAGE WHEN EIGHT FRAMES ARE OVERLAPPED
FOURTH FRAME (FORMAT 2)

| LINE | PIXEL 1 | 2 | 3 | 4 | 5 | 6 | 7 | 8 | |
|---|---|---|---|---|---|---|---|---|---|
| 1 | 4 | 5 | 6 | 7 | 8 | 1 | 2 | 3 | A |
| 2 | 4 | 5 | 6 | 7 | 8 | 1 | 2 | 3 | A |
| 3 | 6 | 7 | 8 | 1 | 2 | 3 | 4 | 5 | B |
| 4 | 6 | 7 | 8 | 1 | 2 | 3 | 4 | 5 | B |
| 5 | 3 | 4 | 5 | 6 | 7 | 8 | 1 | 2 | C |
| 6 | 1 | 2 | 3 | 4 | 5 | 6 | 7 | 8 | D |
| 7 | 1 | 2 | 3 | 4 | 5 | 6 | 7 | 8 | D |
| 8 | 5 | 6 | 7 | 8 | 1 | 2 | 3 | 4 | E |
| 9 | 7 | 8 | 1 | 2 | 3 | 4 | 5 | 6 | A |
| 10 | 7 | 8 | 1 | 2 | 3 | 4 | 5 | 6 | A |
| 11 | 2 | 3 | 4 | 5 | 6 | 7 | 8 | 1 | B |
| 12 | 2 | 3 | 4 | 5 | 6 | 7 | 8 | 1 | B |
| 13 | 8 | 1 | 2 | 3 | 4 | 5 | 6 | 7 | C |

Fig. 11E

DISPLAY IMAGE WHEN EIGHT FRAMES ARE OVERLAPPED FIFTH FRAME (FORMAT 3)

| LINE | PIXEL 1 | 2 | 3 | 4 | 5 | 6 | 7 | 8 | |
|---|---|---|---|---|---|---|---|---|---|
| 1 | 7 | 8 | 1 | 2 | 3 | 4 | 5 | 6 | A |
| 2 | 7 | 8 | 1 | 2 | 3 | 4 | 5 | 6 | A |
| 3 | 5 | 6 | 7 | 8 | 1 | 2 | 3 | 4 | B |
| 4 | 5 | 6 | 7 | 8 | 1 | 2 | 3 | 4 | B |
| 5 | 8 | 1 | 2 | 3 | 4 | 5 | 6 | 7 | C |
| 6 | 2 | 3 | 4 | 5 | 6 | 7 | 8 | 1 | D |
| 7 | 2 | 3 | 4 | 5 | 6 | 7 | 8 | 1 | D |
| 8 | 6 | 7 | 8 | 1 | 2 | 3 | 4 | 5 | E |
| 9 | 4 | 5 | 6 | 7 | 8 | 1 | 2 | 3 | A |
| 10 | 4 | 5 | 6 | 7 | 8 | 1 | 2 | 3 | A |
| 11 | 1 | 2 | 3 | 4 | 5 | 6 | 7 | 8 | B |
| 12 | 1 | 2 | 3 | 4 | 5 | 6 | 7 | 8 | B |
| 13 | 3 | 4 | 5 | 6 | 7 | 8 | 1 | 2 | C |

Fig. 11G

DISPLAY IMAGE WHEN EIGHT FRAMES ARE OVERLAPPED SEVENTH FRAME (FORMAT 4)

| LINE | PIXEL 1 | 2 | 3 | 4 | 5 | 6 | 7 | 8 | |
|---|---|---|---|---|---|---|---|---|---|
| 1 | 2 | 3 | 4 | 5 | 6 | 7 | 8 | 1 | A |
| 2 | 2 | 3 | 4 | 5 | 6 | 7 | 8 | 1 | A |
| 3 | 8 | 1 | 2 | 3 | 4 | 5 | 6 | 7 | B |
| 4 | 8 | 1 | 2 | 3 | 4 | 5 | 6 | 7 | B |
| 5 | 5 | 6 | 7 | 8 | 1 | 2 | 3 | 4 | C |
| 6 | 7 | 8 | 1 | 2 | 3 | 4 | 5 | 6 | D |
| 7 | 7 | 8 | 1 | 2 | 3 | 4 | 5 | 6 | D |
| 8 | 3 | 4 | 5 | 6 | 7 | 8 | 1 | 2 | E |
| 9 | 1 | 2 | 3 | 4 | 5 | 6 | 7 | 8 | A |
| 10 | 1 | 2 | 3 | 4 | 5 | 6 | 7 | 8 | A |
| 11 | 4 | 5 | 6 | 7 | 8 | 1 | 2 | 3 | B |
| 12 | 4 | 5 | 6 | 7 | 8 | 1 | 2 | 3 | B |
| 13 | 6 | 7 | 8 | 1 | 2 | 3 | 4 | 5 | C |

Fig. 11F

DISPLAY IMAGE WHEN EIGHT FRAMES ARE OVERLAPPED SIXTH FRAME (FORMAT 3)

| LINE | PIXEL 1 | 2 | 3 | 4 | 5 | 6 | 7 | 8 | |
|---|---|---|---|---|---|---|---|---|---|
| 1 | 7 | 8 | 1 | 2 | 3 | 4 | 5 | 6 | A |
| 2 | 7 | 8 | 1 | 2 | 3 | 4 | 5 | 6 | A |
| 3 | 5 | 6 | 7 | 8 | 1 | 2 | 3 | 4 | B |
| 4 | 5 | 6 | 7 | 8 | 1 | 2 | 3 | 4 | B |
| 5 | 8 | 1 | 2 | 3 | 4 | 5 | 6 | 7 | C |
| 6 | 2 | 3 | 4 | 5 | 6 | 7 | 8 | 1 | D |
| 7 | 2 | 3 | 4 | 5 | 6 | 7 | 8 | 1 | D |
| 8 | 6 | 7 | 8 | 1 | 2 | 3 | 4 | 5 | E |
| 9 | 4 | 5 | 6 | 7 | 8 | 1 | 2 | 3 | A |
| 10 | 4 | 5 | 6 | 7 | 8 | 1 | 2 | 3 | A |
| 11 | 1 | 2 | 3 | 4 | 5 | 6 | 7 | 8 | B |
| 12 | 1 | 2 | 3 | 4 | 5 | 6 | 7 | 8 | B |
| 13 | 3 | 4 | 5 | 6 | 7 | 8 | 1 | 2 | C |

Fig. 11H

DISPLAY IMAGE WHEN EIGHT FRAMES ARE OVERLAPPED EIGHTH FRAME (FORMAT 4)

| LINE | PIXEL 1 | 2 | 3 | 4 | 5 | 6 | 7 | 8 | |
|---|---|---|---|---|---|---|---|---|---|
| 1 | 2 | 3 | 4 | 5 | 6 | 7 | 8 | 1 | A |
| 2 | 2 | 3 | 4 | 5 | 6 | 7 | 8 | 1 | A |
| 3 | 8 | 1 | 2 | 3 | 4 | 5 | 6 | 7 | B |
| 4 | 8 | 1 | 2 | 3 | 4 | 5 | 6 | 7 | B |
| 5 | 5 | 6 | 7 | 8 | 1 | 2 | 3 | 4 | C |
| 6 | 7 | 8 | 1 | 2 | 3 | 4 | 5 | 6 | D |
| 7 | 7 | 8 | 1 | 2 | 3 | 4 | 5 | 6 | D |
| 8 | 3 | 4 | 5 | 6 | 7 | 8 | 1 | 2 | E |
| 9 | 1 | 2 | 3 | 4 | 5 | 6 | 7 | 8 | A |
| 10 | 1 | 2 | 3 | 4 | 5 | 6 | 7 | 8 | A |
| 11 | 4 | 5 | 6 | 7 | 8 | 1 | 2 | 3 | B |
| 12 | 4 | 5 | 6 | 7 | 8 | 1 | 2 | 3 | B |
| 13 | 6 | 7 | 8 | 1 | 2 | 3 | 4 | 5 | C |

Fig. 11I

DISPLAY IMAGE WHEN EIGHT FRAMES ARE OVERLAPPED

NINTH FRAME (FORMAT 5)

| LINE | PIXEL 1 | 2 | 3 | 4 | 5 | 6 | 7 | 8 | |
|---|---|---|---|---|---|---|---|---|---|
| 1 | 6 | 7 | 8 | 1 | 2 | 3 | 4 | 5 | A |
| 2 | 6 | 7 | 8 | 1 | 2 | 3 | 4 | 5 | A |
| 3 | 4 | 5 | 6 | 7 | 8 | 1 | 2 | 3 | B |
| 4 | 4 | 5 | 6 | 7 | 8 | 1 | 2 | 3 | B |
| 5 | 1 | 2 | 3 | 4 | 5 | 6 | 7 | 8 | C |
| 6 | 3 | 4 | 5 | 6 | 7 | 8 | 1 | 2 | D |
| 7 | 3 | 4 | 5 | 6 | 7 | 8 | 1 | 2 | D |
| 8 | 7 | 8 | 1 | 2 | 3 | 4 | 5 | 6 | E |
| 9 | 5 | 6 | 7 | 8 | 1 | 2 | 3 | 4 | A |
| 10 | 5 | 6 | 7 | 8 | 1 | 2 | 3 | 4 | A |
| 11 | 8 | 1 | 2 | 3 | 4 | 5 | 6 | 7 | B |
| 12 | 8 | 1 | 2 | 3 | 4 | 5 | 6 | 7 | B |
| 13 | 2 | 3 | 4 | 5 | 6 | 7 | 8 | 1 | C |

Fig. 11K

DISPLAY IMAGE WHEN EIGHT FRAMES ARE OVERLAPPED

ELEVENTH FRAME (FORMAT 6)

| LINE | PIXEL 1 | 2 | 3 | 4 | 5 | 6 | 7 | 8 | |
|---|---|---|---|---|---|---|---|---|---|
| 1 | 3 | 4 | 5 | 6 | 7 | 8 | 1 | 2 | A |
| 2 | 3 | 4 | 5 | 6 | 7 | 8 | 1 | 2 | A |
| 3 | 1 | 2 | 3 | 4 | 5 | 6 | 7 | 8 | B |
| 4 | 1 | 2 | 3 | 4 | 5 | 6 | 7 | 8 | B |
| 5 | 4 | 5 | 6 | 7 | 8 | 1 | 2 | 3 | C |
| 6 | 6 | 7 | 8 | 1 | 2 | 3 | 4 | 5 | D |
| 7 | 6 | 7 | 8 | 1 | 2 | 3 | 4 | 5 | D |
| 8 | 2 | 3 | 4 | 5 | 6 | 7 | 8 | 1 | E |
| 9 | 8 | 1 | 2 | 3 | 4 | 5 | 6 | 7 | A |
| 10 | 8 | 1 | 2 | 3 | 4 | 5 | 6 | 7 | A |
| 11 | 5 | 6 | 7 | 8 | 1 | 2 | 3 | 4 | B |
| 12 | 5 | 6 | 7 | 8 | 1 | 2 | 3 | 4 | B |
| 13 | 7 | 8 | 1 | 2 | 3 | 4 | 5 | 6 | C |

Fig. 11J

DISPLAY IMAGE WHEN EIGHT FRAMES ARE OVERLAPPED

TENTH FRAME (FORMAT 5)

| LINE | PIXEL 1 | 2 | 3 | 4 | 5 | 6 | 7 | 8 | |
|---|---|---|---|---|---|---|---|---|---|
| 1 | 6 | 7 | 8 | 1 | 2 | 3 | 4 | 5 | A |
| 2 | 6 | 7 | 8 | 1 | 2 | 3 | 4 | 5 | A |
| 3 | 4 | 5 | 6 | 7 | 8 | 1 | 2 | 3 | B |
| 4 | 4 | 5 | 6 | 7 | 8 | 1 | 2 | 3 | B |
| 5 | 1 | 2 | 3 | 4 | 5 | 6 | 7 | 8 | C |
| 6 | 3 | 4 | 5 | 6 | 7 | 8 | 1 | 2 | D |
| 7 | 3 | 4 | 5 | 6 | 7 | 8 | 1 | 2 | D |
| 8 | 7 | 8 | 1 | 2 | 3 | 4 | 5 | 6 | E |
| 9 | 5 | 6 | 7 | 8 | 1 | 2 | 3 | 4 | A |
| 10 | 5 | 6 | 7 | 8 | 1 | 2 | 3 | 4 | A |
| 11 | 8 | 1 | 2 | 3 | 4 | 5 | 6 | 7 | B |
| 12 | 8 | 1 | 2 | 3 | 4 | 5 | 6 | 7 | B |
| 13 | 2 | 3 | 4 | 5 | 6 | 7 | 8 | 1 | C |

Fig. 11L

DISPLAY IMAGE WHEN EIGHT FRAMES ARE OVERLAPPED

TWELFTH FRAME (FORMAT 6)

| LINE | PIXEL 1 | 2 | 3 | 4 | 5 | 6 | 7 | 8 | |
|---|---|---|---|---|---|---|---|---|---|
| 1 | 3 | 4 | 5 | 6 | 7 | 8 | 1 | 2 | A |
| 2 | 3 | 4 | 5 | 6 | 7 | 8 | 1 | 2 | A |
| 3 | 1 | 2 | 3 | 4 | 5 | 6 | 7 | 8 | B |
| 4 | 1 | 2 | 3 | 4 | 5 | 6 | 7 | 8 | B |
| 5 | 4 | 5 | 6 | 7 | 8 | 1 | 2 | 3 | C |
| 6 | 6 | 7 | 8 | 1 | 2 | 3 | 4 | 5 | D |
| 7 | 6 | 7 | 8 | 1 | 2 | 3 | 4 | 5 | D |
| 8 | 2 | 3 | 4 | 5 | 6 | 7 | 8 | 1 | E |
| 9 | 8 | 1 | 2 | 3 | 4 | 5 | 6 | 7 | A |
| 10 | 8 | 1 | 2 | 3 | 4 | 5 | 6 | 7 | A |
| 11 | 5 | 6 | 7 | 8 | 1 | 2 | 3 | 4 | B |
| 12 | 5 | 6 | 7 | 8 | 1 | 2 | 3 | 4 | B |
| 13 | 7 | 8 | 1 | 2 | 3 | 4 | 5 | 6 | C |

Fig. 11M

DISPLAY IMAGE WHEN EIGHT FRAMES ARE OVERLAPPED

NINTH FRAME (FORMAT 7)

| LINE | PIXEL 1 | 2 | 3 | 4 | 5 | 6 | 7 | 8 | |
|---|---|---|---|---|---|---|---|---|---|
| 1 | 8 | 1 | 2 | 3 | 4 | 5 | 6 | 7 | A |
| 2 | 8 | 1 | 2 | 3 | 4 | 5 | 6 | 7 | A |
| 3 | 2 | 3 | 4 | 5 | 6 | 7 | 8 | 1 | B |
| 4 | 2 | 3 | 4 | 5 | 6 | 7 | 8 | 1 | B |
| 5 | 7 | 8 | 1 | 2 | 3 | 4 | 5 | 6 | C |
| 6 | 5 | 6 | 7 | 8 | 1 | 2 | 3 | 4 | D |
| 7 | 5 | 6 | 7 | 8 | 1 | 2 | 3 | 4 | D |
| 8 | 1 | 2 | 3 | 4 | 5 | 6 | 7 | 8 | E |
| 9 | 3 | 4 | 5 | 6 | 7 | 8 | 1 | 2 | A |
| 10 | 3 | 4 | 5 | 6 | 7 | 8 | 1 | 2 | A |
| 11 | 6 | 7 | 8 | 1 | 2 | 3 | 4 | 5 | B |
| 12 | 6 | 7 | 8 | 1 | 2 | 3 | 4 | 5 | B |
| 13 | 4 | 5 | 6 | 7 | 8 | 1 | 2 | 3 | C |

Fig. 11O

DISPLAY IMAGE WHEN EIGHT FRAMES ARE OVERLAPPED

ELEVENTH FRAME (FORMAT 8)

| LINE | PIXEL 1 | 2 | 3 | 4 | 5 | 6 | 7 | 8 | |
|---|---|---|---|---|---|---|---|---|---|
| 1 | 5 | 6 | 7 | 8 | 1 | 2 | 3 | 4 | A |
| 2 | 5 | 6 | 7 | 8 | 1 | 2 | 3 | 4 | A |
| 3 | 7 | 8 | 1 | 2 | 3 | 4 | 5 | 6 | B |
| 4 | 7 | 8 | 1 | 2 | 3 | 4 | 5 | 6 | B |
| 5 | 2 | 3 | 4 | 5 | 6 | 7 | 8 | 1 | C |
| 6 | 8 | 1 | 2 | 3 | 4 | 5 | 6 | 7 | D |
| 7 | 8 | 1 | 2 | 3 | 4 | 5 | 6 | 7 | D |
| 8 | 4 | 5 | 6 | 7 | 8 | 1 | 2 | 3 | E |
| 9 | 6 | 7 | 8 | 1 | 2 | 3 | 4 | 5 | A |
| 10 | 6 | 7 | 8 | 1 | 2 | 3 | 4 | 5 | A |
| 11 | 3 | 4 | 5 | 6 | 7 | 8 | 1 | 2 | B |
| 12 | 3 | 4 | 5 | 6 | 7 | 8 | 1 | 2 | B |
| 13 | 1 | 2 | 3 | 4 | 5 | 6 | 7 | 8 | C |

Fig. 11N

DISPLAY IMAGE WHEN EIGHT FRAMES ARE OVERLAPPED

TENTH FRAME (FORMAT 7)

| LINE | PIXEL 1 | 2 | 3 | 4 | 5 | 6 | 7 | 8 | |
|---|---|---|---|---|---|---|---|---|---|
| 1 | 8 | 1 | 2 | 3 | 4 | 5 | 6 | 7 | A |
| 2 | 8 | 1 | 2 | 3 | 4 | 5 | 6 | 7 | A |
| 3 | 2 | 3 | 4 | 5 | 6 | 7 | 8 | 1 | B |
| 4 | 2 | 3 | 4 | 5 | 6 | 7 | 8 | 1 | B |
| 5 | 7 | 8 | 1 | 2 | 3 | 4 | 5 | 6 | C |
| 6 | 5 | 6 | 7 | 8 | 1 | 2 | 3 | 4 | D |
| 7 | 5 | 6 | 7 | 8 | 1 | 2 | 3 | 4 | D |
| 8 | 1 | 2 | 3 | 4 | 5 | 6 | 7 | 8 | E |
| 9 | 3 | 4 | 5 | 6 | 7 | 8 | 1 | 2 | A |
| 10 | 3 | 4 | 5 | 6 | 7 | 8 | 1 | 2 | A |
| 11 | 6 | 7 | 8 | 1 | 2 | 3 | 4 | 5 | B |
| 12 | 6 | 7 | 8 | 1 | 2 | 3 | 4 | 5 | B |
| 13 | 4 | 5 | 6 | 7 | 8 | 1 | 2 | 3 | C |

Fig. 11P

DISPLAY IMAGE WHEN EIGHT FRAMES ARE OVERLAPPED

TWELFTH FRAME (FORMAT 8)

| LINE | PIXEL 1 | 2 | 3 | 4 | 5 | 6 | 7 | 8 | |
|---|---|---|---|---|---|---|---|---|---|
| 1 | 5 | 6 | 7 | 8 | 1 | 2 | 3 | 4 | A |
| 2 | 5 | 6 | 7 | 8 | 1 | 2 | 3 | 4 | A |
| 3 | 7 | 8 | 1 | 2 | 3 | 4 | 5 | 6 | B |
| 4 | 7 | 8 | 1 | 2 | 3 | 4 | 5 | 6 | B |
| 5 | 2 | 3 | 4 | 5 | 6 | 7 | 8 | 1 | C |
| 6 | 8 | 1 | 2 | 3 | 4 | 5 | 6 | 7 | D |
| 7 | 8 | 1 | 2 | 3 | 4 | 5 | 6 | 7 | D |
| 8 | 4 | 5 | 6 | 7 | 8 | 1 | 2 | 3 | E |
| 9 | 6 | 7 | 8 | 1 | 2 | 3 | 4 | 5 | A |
| 10 | 6 | 7 | 8 | 1 | 2 | 3 | 4 | 5 | A |
| 11 | 3 | 4 | 5 | 6 | 7 | 8 | 1 | 2 | B |
| 12 | 3 | 4 | 5 | 6 | 7 | 8 | 1 | 2 | B |
| 13 | 1 | 2 | 3 | 4 | 5 | 6 | 7 | 8 | C |

Fig. 12

DISPLAY IMAGE WHEN SIXTEEN FRAMES ARE OVERLAPPED

| LINE | PIXEL 1 | 2 | 3 | 4 | 5 | 6 | 7 | 8 | |
|---|---|---|---|---|---|---|---|---|---|
| 1 | 1 | 1 | 1 | 1 | 1 | 1 | 1 | 1 | A |
| 2 | 1 | 1 | 1 | 1 | 1 | 1 | 1 | 1 | A |
| 3 | 1 | 1 | 1 | 1 | 1 | 1 | 1 | 1 | B |
| 4 | 1 | 1 | 1 | 1 | 1 | 1 | 1 | 1 | B |
| 5 | 1 | 1 | 1 | 1 | 1 | 1 | 1 | 1 | C |
| 6 | 1 | 1 | 1 | 1 | 1 | 1 | 1 | 1 | D |
| 7 | 1 | 1 | 1 | 1 | 1 | 1 | 1 | 1 | D |
| 8 | 1 | 1 | 1 | 1 | 1 | 1 | 1 | 1 | E |
| 9 | 1 | 1 | 1 | 1 | 1 | 1 | 1 | 1 | A |
| 10 | 1 | 1 | 1 | 1 | 1 | 1 | 1 | 1 | A |
| 11 | 1 | 1 | 1 | 1 | 1 | 1 | 1 | 1 | B |
| 12 | 1 | 1 | 1 | 1 | 1 | 1 | 1 | 1 | B |
| 13 | 1 | 1 | 1 | 1 | 1 | 1 | 1 | 1 | C |

DISPLAY APPARATUS IN WHICH NOISE IS NOT DISPLAYED AS REGULAR PATTERN SINCE AVERAGING OPERATION CAN BE PERFECTLY PERFORMED WHEN INTERLACED SCANNING IS PERFORMED

BACKGROUND OF THE INVENTION

1. Field of the Invention

The present invention relates to an active matrix type liquid crystal display apparatus. More particularly, the present invention relates to a liquid crystal display apparatus in which a noise is not displayed as a regular pattern, if an interlaced scanning is performed for jumping over a horizontal display line every other line to write an image data, when an enlarged display is performed on an image display unit, and a display method.

2. Description of the Related Art

In an active matrix type liquid crystal display apparatus, characteristic errors of signal processors are averaged to improve the quality of display.

FIG. 1 is a configuration diagram showing an example of a liquid crystal display apparatus using this averaging operation.

An input image signal Sin is provided with analog R, G and B signals, and is inputted to a time base converter 101. The input image signal Sin may be any of an interlace signal and a progressive signal. The time base converter 101 samples the successively supplied input image signal Sin through a sampling and holding circuit, and then divides the data into n sections in parallel to drop the frequency.

As the input image signal Sin becomes high accurate, an operation frequency of a sampling and holding circuit in an image display driver 104 becomes higher associated with the higher accuracy. Thus, it is difficult to attain a function of the image display driver 104. As shown in FIG. 1, inner operations of the image display driver 104 can be performed in parallel by providing n input terminals for the image display driver 104, in order to drop the operation frequency. The time base converter 101 performs a 2n-paralleling process on the input image signal Sin. So, the signals obtained by the 2n-paralleling process are processed in parallel to each other by 2n signal processors 1 to 2n to drop the operational frequency.

Here, a position at which the time base converter 101 starts sampling the input image signal Sin can be arbitrarily determined in accordance with an SP control signal Ssp2 inputted to the time base converter 101 from a switching controller 106. In short, a data processed by the sampling and holding circuit different for each frame is supplied to a particular pixel. This is an averaging principle.

In the switching controller 106, its averaging period is set at a 2n vertical period and a 2n horizontal period. The vertical period corresponds to the 2n of the number of signal processors 1 to 2n. The horizontal period corresponds to the 2n of the number of signal processors 1 to 2n. The 2n vertical period and the 2n horizontal period will be described later.

The time base converter 101 performs a parallel time base conversion on the input image signal Sin to generate conversion image signals SC1 to SC2n. The number of conversion image signals SC1 to SC2n is equal to two times the division ratio n. The time base converter 101 is connected to 2n signal processors 1 to 2n which are connected parallel to each other. The time base converter 101 outputs the conversion image signals SC1 to SC2n to the signal processors 1 to 2n, respectively.

The signal processors 1 to 2n perform a signal process, such as a γ conversion, a data inversion and the like, on the conversion image signals SC1 to SC2n, respectively, to thereby generate processed image signals SP1 to SP2n.

The signal processors 1 to 2n are connected to a switching selector 103. The switching selector 103, in response to a selector signal Ssel2 outputted from the switching controller 106, selects half n signals from the image signals (the processed image signals SP1 to SP2n) corresponding to 2n dots stored in the signal processors 1 to 2n. This is because the switching selector 103 samples the processed image signals corresponding to the latter n dots while the switching selector 103 outputs the processed image signals corresponding to the former n dots as image signals S1 to Sn.

The switching selector 103 outputs the image signals S1 to Sn divided into the n sections, from n output sections SO1 to SOn. The image signal S1 is outputted from the first output section SO1 of the switching selector 103, the image signal S2 is outputted from the second output section SO2, and the image signal Sn is outputted from the n-th output section SOn.

The processed image signal processed by which number of signal processor among the signal processors 1 to 2n to be outputted as the image signal S1 from the first output section SO1 can be selected as desired. At this time, the processed image signals outputted as the image signals S2, S3 to Sn from the second, third to n-th output sections SO2, SO3 to SOn following the first output section SO1 are selected such that they are arranged in order with respect to the processed image signal outputted as the image signal S1 from the first output section SO1.

For example, the number of signal processors 1 to 2n is defined as 8 (n=4). Here, it is assumed that the processed image signal SP3 outputted from the third signal processor 3 is outputted as the image signal S1 from the first output section SO1 of the switching selector 103. In this case, the processed image signals SP3, SP4, SP5 and SP6 outputted from the signal processors 3, 4, 5 and 6 in the former period are outputted as the image signals S1 to S4, from the first to fourth output sections SO1 to SO4. Also in the latter period, the processed image signals SP7, SP8, SP1 and SP2 outputted from the signal processors 7, 8, 1 and 2 are outputted as the image signals S1 to S4, from the first to fourth output sections SO1 to SO4.

The image signals S1 to Sn outputted from the output sections SO1 to SOn of the switching selector 103 are supplied to the image display driver 104. The image display driver 104 is provided with a plurality of blocks arrayed along an image display unit 105 composed of a liquid crystal panel and the like. The image display driver 104 outputs the image signals to the image display unit 105, each time it samples the image signals S1 to Sn divided into the n sections by the switching selector 103 by using an n-division clock signal, or after it completes sampling the image signals in one horizontal period.

The image signals S1 to Sn outputted from the switching selector 103 are inputted to one terminal of the plurality of blocks of the image display driver 104, and sequentially shifted to another block. Then, the image display driver 104 samples a pixel data of each block at a predetermined frequency.

The operation of the liquid crystal display apparatus shown in FIG. 1 will be described below with reference to FIGS. 2A to 6.

FIGS. 2A to 2H show averaging patterns generated by the switching controller 106 if the number of signal processors 1 to 2n is 8 (n=4), namely, formats 1 to 8. One table described in each of FIGS. 2A to 2H shows an averaging pattern in one frame. A horizontal axis indicates an order in a horizontal direction, and a vertical axis indicates an order in a vertical direction.

Numerals in the respective tables denote the numbers corresponding to the processed image signals SP1 to SP8 outputted from the selected signal processors 1 to 8. A slant line portion indicates that the processed image signal SP1 outputted from the first signal processor 1 is selected.

FIGS. 3A to 3H show display images when the averaging patterns of FIGS. 2A to 2H are used, respectively. Numerals in respective tables indicate that the image data (processed image signals) SP1 to SP8 processed by the signal processors 1 to 8 corresponding to its number are displayed. A slant line portion indicates a position on the display screen of the image display unit 105 of the processed image signal SP1 processed by the first signal processor 1. A horizontal axis indicates a pixel which is a set of respective dots of R, G and B of the image display unit 105, and a vertical axis indicates a horizontal line.

A first frame (a format 1) of FIG. 3A is exemplified and described. In the first pixel on the first horizontal line, the processed image signal SP1 processed by the first signal processor 1 is indicated as a number [1]. Hereafter, in order from the second pixel to the eighth pixel, the processed image signals SP2 to SP8 processed by the second to eighth signal processors 2 to 8 are indicated as respective numbers [2, 3, 4, 5, 6, 7 and 8].

Similarly, in the first pixel on the second horizontal line, the processed image signal SP3 processed by the third signal processor 3 is indicated as a number [3]. After the first pixel on the second horizontal line, the processed image signals SP4, SP5, SP6, SP7, SP8, SP1 and SP2 are sequentially indicated as numbers [4, 5, 6, 7, 8, 1 and 2]. This case implies that the processed image signal SP1 processed by the first signal processor 1 is indicated in the seventh pixel on the second horizontal line. The procedure after that is same. Thus, its description is omitted.

Here, in the successive eight horizontal lines, it is selected such that the same image data (for example, the processed image signal SP1) is not displayed in a particular pixel (for example, the first pixel). This selecting method is performed on one frame (the successive eight horizontal lines). Thus, in order to uniformly locate the image signals (the processed image signals SP1 to SP8) processed by the 8 signal processors 1 to 8 in all eight pixels on all the eight horizontal lines, 8 frames are needed as shown in FIGS. 3A to 3H.

FIGS. 4A to 4H show a display images when a 1.6-times enlarged displaying is performed on each of the averaging patterns of FIGS. 2A to 2H. The 1.6-times enlarged displaying is attained by using the following method. From image data of five lines, each of image data of three lines is displayed as two lines. In each of FIGS. 4A to 4H, from five lines A to E in each of FIGS. 3A to 3H, each of the lines A, B and D is displayed with two lines to thereby carry out the enlarged displaying.

If such enlarged displaying is done, data of one line is enlarged as the two lines. Thus, in the enlarged portion, the averaging pattern is similarly enlarged. Also, in this case, the data is written to the image display unit 105, two times in one horizontal period. Thus, a write time is equal to half the normal time. So, in order to reserve the write time corresponding to the one horizontal period similarly to the normal case, an interlaced scanning is performed on the enlarged result of each of FIGS. 4A to 4H, as shown in each of FIGS. 5A to 5H. A half-tone dot meshing portion indicates a line jumped over in each frame. Even-numbered lines are jumped over in each of the odd-numbered frames, and odd-numbered lines are jumped over in each of even-numbered frames.

As mentioned above, when the 1.6-times enlarged displaying is done in the image display unit 105, the interlaced scanning is carried out for making the write time equal to the normal case that the 1.6-times enlarged displaying is not done.

Next, FIG. 6 is explained. The processed image signal SP1 ([1]) processed by the first signal processor S1 is extracted from the remaining portion that is not jumped over in each of 8 formats in FIGS. 5A to 5H. FIG. 6 shows the state that in this case, the portions [1] included in the 8 formats are overwritten. As shown in FIG. 6, blank portions BK are generated. As a result, the noise in the form of lattice is displayed.

As mentioned above, when the number of signal processors is 2n, the averaging period is as follows. That is, if a certain pixel in the image display unit 105 is noted, the averaging is attained in a vertically temporal time axis at the 2n vertical periods. Similarly, the averaging is attained in the horizontally time base axis at the 2n horizontal periods. That is, the perfectly averaging operation are possible in the vertical period and the horizontal period corresponding to the number of signal processors.

However, when the enlarged displaying is done, if the interlaced scanning is carried out, the jumped over one horizontal (line) data is not drawn on the image display unit 105. This causes the averaging operation to be imperfect. The image signal finally outputted from the certain particular signal processor is displayed on the image display unit 105, as shown in FIG. 6. Its certain determined pattern is displayed on the image display unit 105 as the noise in the form of lattice.

In addition, in order to improve the quality of the display after the averaging operation, Japanese Laid Open Patent Application (JP-A-Heisei, 4-355788) discloses a technique that a switching circuit can switch between one of terminals of a driving circuit and one of signal processors at a vertical period or a horizontal period freely. However, although the switching circuit can be arbitrarily switched between them at the vertical or horizontal period, its period is always predetermined to be fixed. Therefore, when the interlaced scanning is done based on the fixed period, averaging patterns obtained by the fixed period are inadequate. Thus, it is difficult to surely guard against the noise in the form of lattice, as mentioned above.

SUMMARY OF THE INVENTION

The present invention has been made to solve the above-described problems of the conventional method of driving a display apparatus. An object of the present invention is to provide a method of driving a display apparatus which can obtain a high quality display without any noise in a form of lattice, in which an averaging operation can be perfectly done even if a interlaced scanning is done. In this case, the display apparatus can be an active matrix type liquid crystal display apparatus.

In order to achieve an aspect of the present invention, a method of driving a display apparatus, includes: (a) providing a plurality of processors outputting a plurality of output signals, respectively; (b) providing a plurality of frames, wherein each of the plurality of frames has an averaging pattern for averaging characteristic errors of the plurality of processors and has a plurality of lines; (c) performing a first scanning on a predetermined frame of the plurality of frames such that a predetermined line of the plurality of lines of the predetermined frame is not scanned; and (d) performing a second scanning on a specific frame of the plurality of frames such that a line corresponding to the predetermined line of the specific frame is scanned, the specific frame having a same averaging pattern as the averaging pattern of the predetermined frame.

In order to achieve another aspect of the present invention, a method of driving a display apparatus, further includes: (e) performing a third scanning on the predetermined frame such that all lines of the predetermined frame are scanned; and (f) performing a forth scanning on the specific frame such that all lines of the specific frame are scanned, and wherein one of first and second groups is performed selectively, the first group including the (c) and (d) steps and the second group including the (e) and (f) steps In this case, the first group is performed when each of the plurality of frames is displayed to be enlarged such that a single line of the plurality of lines is displayed as the lines of two, and the second group is performed when each of the plurality of frames is displayed not to be enlarged.

In order to achieve still another aspect of the present invention, a method of driving a display apparatus, includes: (aa) providing a plurality of processors of M (M is a positive integer) outputting a plurality of output signals of the M, respectively; (ab) providing a plurality of frames, wherein each of the plurality of frames is formed to be a matrix with a plurality of lines of the M rows and a plurality of pixels of the M columns, and wherein the plurality of output signals of the M are inputted to the plurality of pixels of the M columns on a specific line of the plurality of lines of the M rows, respectively, and are inputted to the plurality of pixels of the M of a specific column of the M columns on the plurality of lines of the M rows, respectively, to generate an averaging pattern in the each frame; and (ac) performing a scanning on a predetermined frame of the plurality of frames such that a predetermined line of the plurality of lines of the predetermined frame is not scanned, and (ad) performing a scanning on a specific frame of the plurality of frames such that a line corresponding to the predetermined line of the specific frame is scanned, the specific frame having a same averaging pattern as the averaging pattern of the predetermined frame.

In this case, the plurality of output signals of the M are obtained by a result that an image signal is time-base converted to generate a plurality of converted signals of the M and the plurality of converted signals of the M are inputted to the plurality of processors of the M, respectively.

Also in this case, each of the plurality of frames is displayed to be enlarged such that a single line of the plurality of lines of the M rows is displayed as the lines of two.

Further in this case, the (ab) step includes providing the plurality of frames of double the M which have a plurality of the averaging patterns of the M type.

In this case, when the (c) step is performed, an even-numbered line as the predetermined line of the predetermined frame is not scanned and an odd-numbered line of the predetermined frame is scanned, and when the (d) step is performed, an odd-numbered line of the specific frame is not scanned and an even-numbered line as the line of the specific frame is scanned.

Also in this case, when the pixel of P-th (P is a positive integer) of the plurality of the pixels of the M columns on a predetermined line of the plurality of lines of the M rows inputs the output signal outputted from the processor of Q-th (Q is a positive integer) of the plurality of processors of the M, the pixel of (the P+1)-th of the plurality of the pixels of the M columns on the predetermined line inputs the output signal outputted from the processor of (the Q+1)-th of the plurality of processors of the M.

Further in this case, a single cycle of averaging characteristic errors of the plurality of processors of the M consists of the plurality of frames of double the M which have a plurality of the averaging patterns of the M.

In order to achieve yet still another aspect of the present invention, a display apparatus, includes: a display unit displaying an image based on a plurality of frames; a time base converter dividing an image signal on a time base in response to a first control signal to generate a plurality of converted signals of M (M is a positive integer); a plurality of processors of the M outputting a plurality of output signals of the M based on the plurality of converted signals of the M, respectively; a frame generating unit generating the plurality of frames based on the plurality of output signals in response to a second control signal such that each of the plurality of frames has an averaging pattern for averaging characteristic errors of the plurality of processors of the M; and a control circuit generating the first and second control signals such that the time base converter generates the plurality of converted signals of double the M in a single period of the averaging in response to the first control signal, and the frame generating unit generates the plurality of frames of double the M in the single period in response to the second control signal.

In this case, the display unit is a liquid crystal display of active matrix type.

Also in this case, the control circuit generates the first control signal such that the time base converter generates the plurality of converted signals of double the M in a vertical period corresponding to (the M×2) and a horizontal period corresponding to the M in response to the first control signal.

Further in this case, the control circuit generates the second control signal such that the frame generating unit generates the plurality of frames of double the M in a vertical period corresponding to (the M×2) and a horizontal period corresponding to the M in response to the second control signal.

In this case, a division ratio when the time base converter divides the image signal corresponds to (the M divided by 2).

In order to achieve another aspect of the present invention, a display apparatus, includes: a plurality of processors outputting a plurality of output signals, respectively; a plurality of frames, wherein each of the plurality of frames has an averaging pattern for averaging characteristic errors of the plurality of processors and has a plurality of lines; a scanning unit performing a first scanning on a predetermined frame of the plurality of frames such that a predetermined line of the plurality of lines of the predetermined frame is not scanned, and performing a second scanning on a specific frame of the plurality of frames such that a line corresponding to the predetermined line of the specific frame is scanned, the specific frame having a same averaging pattern as the averaging pattern of the predetermined frame.

In this case, the scanning unit performs a third scanning on the predetermined frame such that all lines of the predetermined frame are scanned, and performs a forth scanning on the specific frame such that all lines of the specific frame are scanned, and performs one of first and second groups selectively, the first group including the first and second scannings and the second group including the third and fourth scannings.

Also in this case, the scanning unit performs the first group when each of the plurality of frames is displayed to be enlarged such that a single line of the plurality of lines is displayed as the lines of two, and performs the second group when each of the plurality of frames is displayed not to be enlarged.

Further in this case, when the scanning unit performs the first scanning, the scanning unit scans an odd-numbered line of the predetermined frame without scanning an even-numbered line as the predetermined line of the predetermined frame and when the scanning unit performs the second scanning, the scanning unit scans an even-numbered line as the line of the specific frame without scanning an odd-numbered line of the specific frame.

In order to achieve still another aspect of the present invention, a display apparatus, includes: a plurality of processors of M (M is a positive integer) outputting a plurality of output signals of the M, respectively; a frame generating unit generating a plurality of frames, wherein each of the plurality of frames is formed to be a matrix with a plurality of lines of the M rows and a plurality of pixels of the M columns, and wherein the plurality of output signals of the M are inputted to the plurality of pixels of the M columns on a specific line of the plurality of lines of the M rows, respectively, and are inputted to the plurality of pixels of the M of a specific column of the M columns on the plurality of lines of the M rows, respectively, to generate an averaging pattern in the each frame; and a scanning unit performing a scanning on a predetermined frame of the plurality of frames such that a predetermined line of the plurality of lines of the predetermined frame is not scanned, and performing a scanning on a specific frame of the plurality of frames such that a line corresponding to the predetermined line of the specific frame is scanned, the specific frame having a same averaging pattern as the averaging pattern of the predetermined frame.

In this case, a display apparatus further includes: a time base converter time-converting an image signal to generate a plurality of converted signals of the M, and wherein the plurality of processors of the M input the plurality of converted signals of the M to output the plurality of output signals of the M, respectively.

Also in this case, each of the plurality of frames is displayed to be enlarged such that a single line of the plurality of lines of the M rows is displayed as the lines of two.

Further in this case, the frame generating unit generates the plurality of frames of double the M which have a plurality of the averaging patterns of the M type.

In this case, when the pixel of P-th (P is a positive integer) of the plurality of the pixels of the M columns on a predetermined line of the plurality of lines of the M rows inputs the output signal outputted from the processor of Q-th (Q is a positive integer) of the plurality of processors of the M, the pixel of (the P+1)-th of the plurality of the pixels of the M columns on the predetermined line inputs the output signal outputted from the processor of (the Q+1)-th of the plurality of processors of the M.

Also in this case, a single cycle of averaging characteristic errors of the plurality of processors of the M consists of the plurality of frames of double the M which have a plurality of the averaging patterns of the M.

In order to achieve yet still another aspect of the present invention, a computer readable recording medium for recording a program for a process, includes: (g) providing a plurality of processors outputting a plurality of output signals, respectively; (h) providing a plurality of frames, wherein each of the plurality of frames has an averaging pattern for averaging characteristic errors of the plurality of processors and has a plurality of lines; (i) performing a first scanning on a predetermined frame of the plurality of frames such that a predetermined line of the plurality of lines of the predetermined frame is not scanned; and (j) performing a second scanning on a specific frame of the plurality of frames such that a line corresponding to the predetermined line of the specific frame is scanned, the specific frame having a same averaging pattern as the averaging pattern of the predetermined frame.

In a liquid crystal display apparatus of the present invention, an input image signal is divided on a time base and then an active matrix type displaying is performed on an image display unit while rearranging the divided image signals in accordance with an averaging format. In the liquid crystal display apparatus, the same averaging format is used in a frame interlaced (jumped over) of an even-numbered line and another frame interlaced (jumped over) of an odd-numbered line, when an interlaced scanning is performed on the image display unit.

That is, as one embodiment to attain the present invention, a liquid crystal display includes: a time base converter for dividing an input image signal on a time base; a plurality of signal processors for respectively performing a signal process on the divided image signal; a switching selector for selecting outputs of the respective signal processors; an image display unit for sequentially receiving the outputs selected by the switching selector and carrying out a display of an active matrix type; and a first switching controller for outputting a control signal to control a selection order of the outputs of the respective signal processors in the switching selector in accordance with a set averaging format, wherein the first switching controller is designed so as to use the same averaging format in a frame jumping over an even-numbered line and a frame jumping over an odd-numbered line, at a time of a interlaced scanning in the image display unit.

Also, the present invention may be designed so as to include: a second switching controller for using he averaging formats which are respectively different between the frame jumping over the even-numbered line and the frame jumping over the odd-numbered line, as the averaging format; and a selecting circuit for selecting the respective control signals from the first switching controller and the second switching controller, wherein it may be designed so as to select the control signal from the second switching controller if the interlaced scanning is not done in the image display unit.

Moreover, in the present invention, a displaying method is provided that in a liquid crystal display, which divides an input image signal on a time base and then carries out a display of an active matrix type on an image display unit while rearranging the divided image signals in accordance with an averaging format, uses the same averaging format in a frame jumping over an even-numbered line and a frame jumping over an odd-numbered line, at a time of a interlaced scanning in the image display unit.

According to the present invention, in an active matrix type liquid crystal display, when a interlaced scanning is done to display an image signal by jumping over a horizontal display line every other line, such as an enlarged display and the like, the same averaging format is used in a frame jumping over an even-numbered line and a frame jumping over an odd-numbered line.

Thus, an averaging pattern when a data on a horizontal line is jumped over is used when a different horizontal line is jumped over in another frame, which enables the perfectly averaging operation. Hence, even if the interlaced scanning is done, the noise in the form of lattice can be surely protected.

BRIEF DESCRIPTION OF THE DRAWINGS

A more complete understanding of the teachings of the present invention may be acquired by referring to the accompanying figures, in which like reference numbers indicate like features and wherein:

FIG. 2A is a view showing an averaging pattern obtained by a conventional switching controller;

FIG. 2B is a view showing another averaging pattern obtained by the conventional switching controller;

FIG. 2C is a view showing still another averaging pattern obtained by the conventional switching controller;

FIG. 2D is a view showing still another averaging pattern obtained by the conventional switching controller;

FIG. 2E is a view showing still another averaging pattern obtained by the conventional switching controller;

FIG. 2F is a view showing still another averaging pattern obtained by the conventional switching controller;

FIG. 2G is a view showing still another averaging pattern obtained by the conventional switching controller;

FIG. 2H is a view showing still another averaging pattern obtained by the conventional switching controller;

FIG. 3A is a view showing a display image using the averaging pattern of FIG. 2A;

FIG. 3B is a view showing a display image using the averaging pattern of FIG. 2B;

FIG. 3C is a view showing a display image using the averaging pattern of FIG. 2C;

FIG. 3D is a view showing a display image using the averaging pattern of FIG. 2D;

FIG. 3E is a view showing a display image using the averaging pattern of FIG. 2E;

FIG. 3F is a view showing a display image using the averaging pattern of FIG. 2F;

FIG. 3G is a view showing a display image using the averaging pattern of FIG. 2G;

FIG. 3H is a view showing a display image using the averaging pattern of FIG. 2H;

FIG. 4A is a view showing a display image when a 1.6-times enlarged displaying is performed on FIG. 3A;

FIG. 4B is a view showing a display image when a 1.6-times enlarged displaying is performed on FIG. 3B;

FIG. 4C is a view showing a display image when a 1.6-times enlarged displaying is performed on FIG. 3C;

FIG. 4D is a view showing a display image when a 1.6-times enlarged displaying is performed on FIG. 3D;

FIG. 4E is a view showing a display image when a 1.6-times enlarged displaying is performed on FIG. 3E;

FIG. 4F is a view showing a display image when a 1.6-times enlarged displaying is performed on FIG. 3F;

FIG. 4G is a view showing a display image when a 1.6-times enlarged displaying is performed on FIG. 3G;

FIG. 4H is a view showing a display image when a 1.6-times enlarged displaying is performed on FIG. 3H;

FIG. 5A is a view showing display image when a interlaced scanning is performed on FIG. 4A;

FIG. 5B is a view showing display image when a interlaced scanning is performed on FIG. 4B;

FIG. 5C is a view showing display image when a interlaced scanning is performed on FIG. 4C;

FIG. 5D is a view showing display image when a interlaced scanning is performed on FIG. 4D;

FIG. 5E is a view showing display image when a interlaced scanning is performed on FIG. 4E;

FIG. 5F is a view showing display image when a interlaced scanning is performed on FIG. 4F;

FIG. 5G is a view showing display image when a interlaced scanning is performed on FIG. 4G;

FIG. 5H is a view showing display image when a interlaced scanning is performed on FIG. 4H;

FIG. 6 is a view showing a state that a particular image signal is displayed on an image display unit, in the conventional technique;

FIG. 8A is a view showing an averaging pattern obtained by the switching controller of the present invention;

FIG. 8B is a view showing another averaging pattern obtained by the switching controller of the present invention;

FIG. 8C is a view showing still another averaging pattern obtained by the switching controller of the present invention;

FIG. 8D is a view showing still another averaging pattern obtained by the switching controller of the present invention;

FIG. 8E is a view showing still another averaging pattern obtained by the switching controller of the present invention;

FIG. 8F is a view showing still another averaging pattern obtained by the switching controller of the present invention;

FIG. 8G is a view showing still another averaging pattern obtained by the switching controller of the present invention;

FIG. 8H is a view showing still another averaging pattern obtained by the switching controller of the present invention;

FIG. 8I is a view showing still another averaging pattern obtained by the switching controller of the present invention;

FIG. 8J is a view showing still another averaging pattern obtained by the switching controller of the present invention;

FIG. 8K is a view showing still another averaging pattern obtained by the switching controller of the present invention;

FIG. 8L is a view showing still another averaging pattern obtained by the switching controller of the present invention;

FIG. 8M is a view showing still another averaging pattern obtained by the switching controller of the present invention;

FIG. 8N is a view showing still another averaging pattern obtained by the switching controller of the present invention;

FIG. 8O is a view showing still another averaging pattern obtained by the switching controller of the present invention;

FIG. 8P is a view showing still another averaging pattern obtained by the switching controller of the present invention;

FIG. 9A is a view showing a display image using the averaging pattern of FIG. 8A;

FIG. 9B is a view showing a display image using the averaging pattern of FIG. 8B;

FIG. 9C is a view showing a display image using the averaging pattern of FIG. 8C;

FIG. 9D is a view showing a display image using the averaging pattern of FIG. 8D;

FIG. 9E is a view showing a display image using the averaging pattern of FIG. 8E;

FIG. 9F is a view showing a display image using the averaging pattern of FIG. 8F;

FIG. 9G is a view showing a display image using the averaging pattern of FIG. 8G;

FIG. 9H is a view showing a display image using the averaging pattern of FIG. 8H;

FIG. 9I is a view showing a display image using the averaging pattern of FIG. 8I;

FIG. 9J is a view showing a display image using the averaging pattern of FIG. 8J;

FIG. 9K is a view showing a display image using the averaging pattern of FIG. 8K;

FIG. 9L is a view showing a display image using the averaging pattern of FIG. 8L;

FIG. 9M is a view showing a display image using the averaging pattern of FIG. 8M;

FIG. 9N is a view showing a display image using the averaging pattern of FIG. 8N;

FIG. 9O is a view showing a display image using the averaging pattern of FIG. 8O;

FIG. 9P is a view showing a display image using the averaging pattern of FIG. 8P;

FIG. 10A is a view showing display image when the 1.6-times enlarged displaying is performed on FIG. 9A;

FIG. 10B is a view showing display image when the 1.6-times enlarged displaying is performed on FIG. 9B;

FIG. 10C is a view showing display image when the 1.6-times enlarged displaying is performed on FIG. 9C;

FIG. 10D is a view showing display image when the 1.6-times enlarged displaying is performed on FIG. 9D;

FIG. 10E is a view showing display image when the 1.6-times enlarged displaying is performed on FIG. 9E;

FIG. 10F is a view showing display image when the 1.6-times enlarged displaying is performed on FIG. 9F;

FIG. 10G is a view showing display image when the 1.6-times enlarged displaying is performed on FIG. 9G;

FIG. 10H is a view showing display image when the 1.6-times enlarged displaying is performed on FIG. 9H;

FIG. 10I is a view showing display image when the 1.6-times enlarged displaying is performed on FIG. 9I;

FIG. 10J is a view showing display image when the 1.6-times enlarged displaying is performed on FIG. 9J;

FIG. 10K is a view showing display image when the 1.6-times enlarged displaying is performed on FIG. 9K;

FIG. 10L is a view showing display image when the 1.6-times enlarged displaying is performed on FIG. 9L;

FIG. 10M is a view showing display image when the 1.6-times enlarged displaying is performed on FIG. 9M;

FIG. 10N is a view showing display image when the 1.6-times enlarged displaying is performed on FIG. 9N;

FIG. 10O is a view showing display image when the 1.6-times enlarged displaying is performed on FIG. 9O;

FIG. 10P is a view showing display image when the 1.6-times enlarged displaying is performed on FIG. 9P;

FIG. 11A is a view showing display image when the interlaced scanning is performed on FIG. 10A;

FIG. 11B is a view showing display image when the interlaced scanning is performed on FIG. 10B;

FIG. 11C is a view showing display image when the interlaced scanning is performed on FIG. 10C;

FIG. 11D is a view showing display image when the interlaced scanning is performed on FIG. 10D;

FIG. 11E is a view showing display image when the interlaced scanning is performed on FIG. 10E;

FIG. 11F is a view showing display image when the interlaced scanning is performed on FIG. 10F;

FIG. 11G is a view showing display image when the interlaced scanning is performed on FIG. 10G;

FIG. 11H is a view showing display image when the interlaced scanning is performed on FIG. 10H;

FIG. 11I is a view showing display image when the interlaced scanning is performed on FIG. 10I;

FIG. 11J is a view showing display image when the interlaced scanning is performed on FIG. 10J;

FIG. 11K is a view showing display image when the interlaced scanning is performed on FIG. 10K;

FIG. 11L is a view showing display image when the interlaced scanning is performed on FIG. 10L;

FIG. 11M is a view showing display image when the interlaced scanning is performed on FIG. 10M;

FIG. 11N is a view showing display image when the interlaced scanning is performed on FIG. 10N;

FIG. 11O is a view showing display image when the interlaced scanning is performed on FIG. 10O;

FIG. 11P is a view showing display image when the interlaced scanning is performed on FIG. 10P;

FIG. 12 is a view showing a state that a particular image signal is displayed on an image display unit in the present invention.

DESCRIPTION OF THE PREFERRED EMBODIMENTS

Embodiments of the present invention will be described below with reference to the attached drawings.

Figure 1:
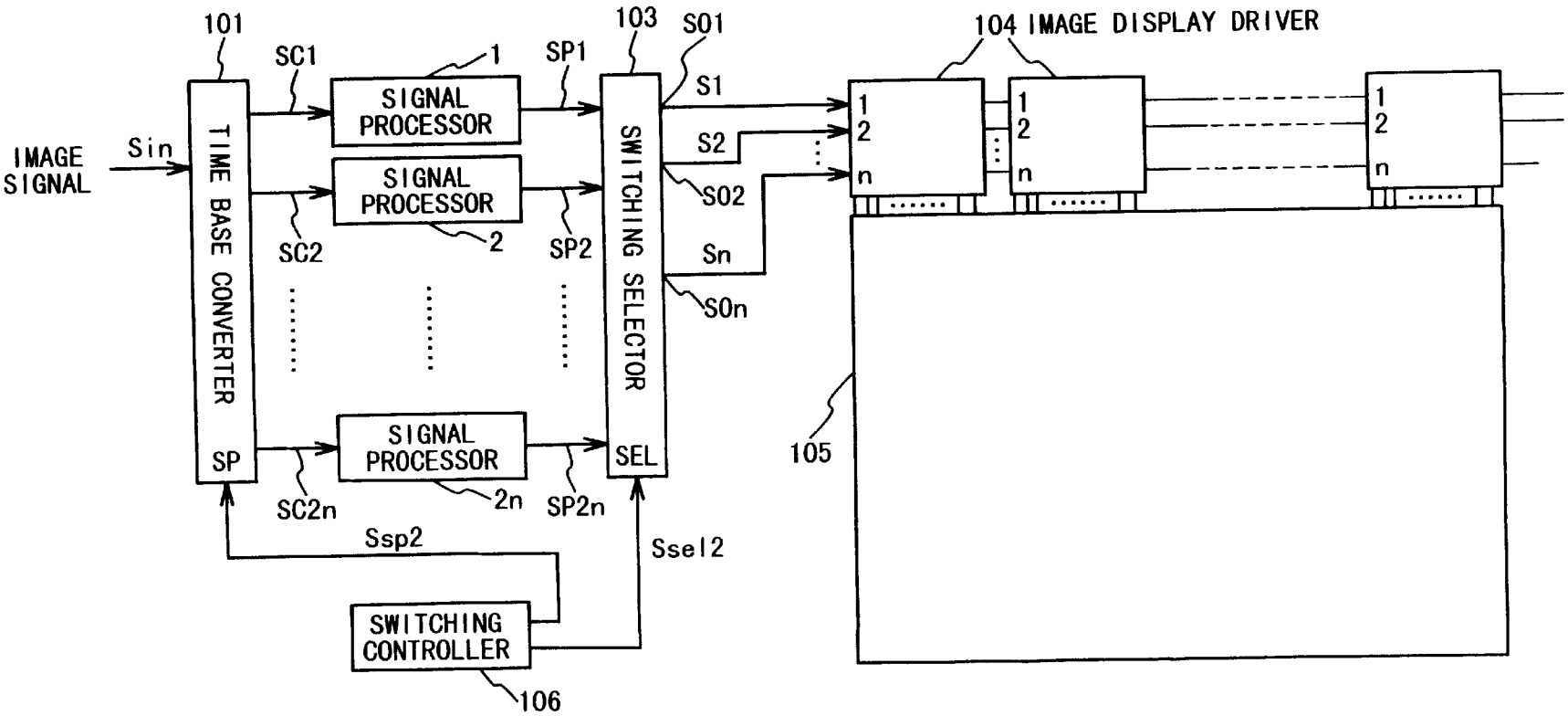
Fig. 1 PRIOR ART
FIG. 1 is a block diagram showing an example of conventional liquid crystal display apparatus.
Figure 7:
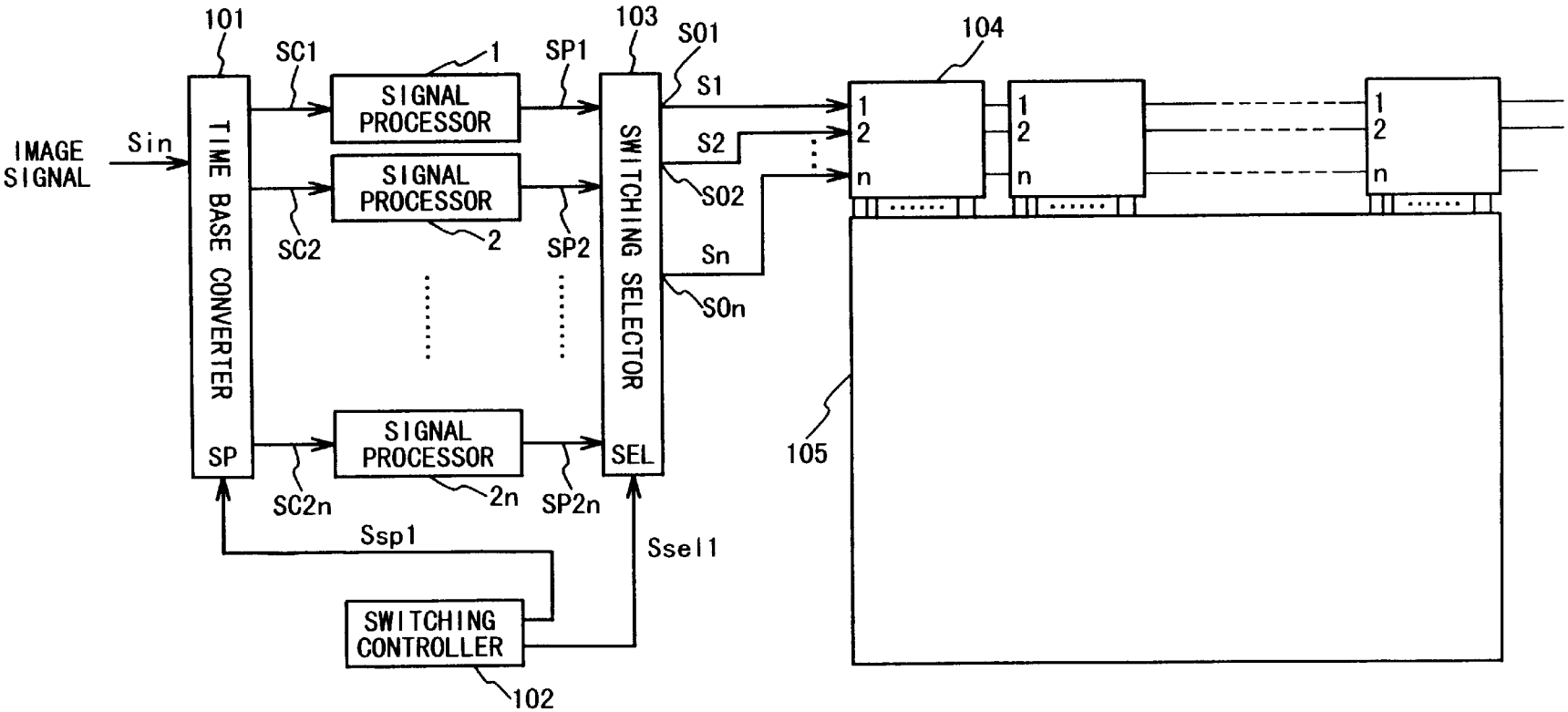
FIG. 7 is a block diagram showing a first embodiment of the present invention.

FIG. 7 is a block diagram showing a first embodiment of an active matrix type liquid crystal display apparatus of the present invention. Here, it is shown as a liquid crystal display apparatus used as an image display unit of a personal computer and the like. In addition, the same symbols are given to those equivalent to the conventional configuration shown in FIG. 1.

An input image signal Sin is provided with analog R, G and B signals, and is inputted to a time base converter 101. The input image signal Sin may be any of an interlace signal and a progressive signal. The time base converter 101 samples the successively supplied input image signal Sin through a sampling and holding circuit, and then divides the data into n sections in parallel to drop the frequency.

As the input image signal Sin becomes high accurate, an operation frequency of a sampling and holding circuit in an image display driver 104 becomes higher associated with the higher accuracy. Thus, it is difficult to attain a function of the image display driver 104. As shown in FIG. 7, inner operations of the image display driver 104 can be performed in parallel by providing n input terminals for the image display driver 104, in order to drop the operation frequency. The time base converter 101 performs a 2n paralleling process on the input image signal Sin. So, the signals obtained by the 2n-paralleling process are processed in parallel to each other by 2n signal processors 1 to 2n to drop the operational frequency.

Here, a position at which the time base converter 101 starts sampling the input image signal Sin can be arbitrarily determined in accordance with an SP control signal Ssp2 inputted to the time base converter 101 from a switching controller 102. In short, a data processed by the sampling and holding circuit different for each frame is supplied to a particular pixel. This is an averaging principle.

Here, in the switching controller 102, its averaging period is not different from the 2n vertical period and the 2n horizontal period of the conventional switching controller 106. Then, its vertical period is set at a 2n×2 vertical period equal to two times the conventional vertical period, and its horizontal period is set at the 2n horizontal period. The vertical period corresponds to two times the 2n of the number of signal processors 1 to 2n. The horizontal period corresponds to the 2n of the number of signal processors 1 to 2n.

The time base converter 101 performs a parallel time base conversion on the input image signal Sin to generate conversion image signals SC1 to SC2n. The number of conversion image signals SC1 to SC2n is equal to two times the division ratio n. The time base converter 101 is connected to 2n signal processors 1 to 2n which are connected parallel to each other. The time base converter 101 outputs the conversion image signals SC1 to SC2n to the signal processors 1 to 2n, respectively.

The signal processors 1 to 2n perform a signal process, such as a γ conversion, a data inversion and the like, on the conversion image signals SC1 to SC2n, respectively, to thereby generate processed image signals SP1 to SP2n. The signal processors 1 to 2n are connected to a switching selector 103.

The switching selector 103, in response to a selector signal Ssell outputted from the switching controller 102, selects half n signals from the image signals (the processed image signals SP1 to SP2n ) corresponding to 2n dots stored in the signal processors 1 to 2n. This is because the switching selector 103 samples the processed image signals corresponding to the latter n dots while the switching selector 103 outputs the processed image signals corresponding to the former n dots as image signals S1 to Sn.

The switching selector 103 outputs the image signals S1 to Sn divided into the n sections, from n output sections SO1 to SOn. The image signal S1 is outputted from the first output section SO1 of the switching selector 103, the image signal S2 is outputted from the second output section SO2, and the image signal Sn is outputted from the n-th output section SOn.

The processed image signal processed by which number of signal processor among the signal processors 1 to 2n to be outputted as the image signal S1 from the first output section SO1 can be selected as desired. At this time, the processed image signals outputted as the image signals S2, S3 to Sn from the second, third to n-th output sections SO2, SO3 to SOn following the first output section SO1 are selected such that they are arranged in order with respect to the processed image signal outputted as the image signal S1 from the first output section SO1.

For example, the number of signal processors 1 to 2n is defined as 8 (n=4). Here, it is assumed that the processed image signal SP3 outputted from the third signal processor 3 is outputted as the image signal S1 from the first output section SO1 of the switching selector 103. In this case, the processed image signals SP3, SP4, SP5 and SP6 outputted from the signal processors 3, 4, 5 and 6 in the former period are outputted as the image signals S1 to S4, from the first to fourth output sections SO1 to SO4. Also in the latter period, the processed image signals SP7, SP8, SP1 and SP2 outputted from the signal processors 7, 8, 1 and 2 are outputted as the image signals S1 to S4, from the first to fourth output sections SO1 to SO4.

The image signals S1 to Sn outputted from the output sections SO1 to SOn of the switching selector 103 are supplied to the image display driver 104. The image display driver 104 is provided with a plurality of blocks arrayed along an image display unit 105 composed of a liquid crystal panel and the like. The image display driver 104 outputs the image signals to the image display unit 105, each time it samples the image signals S1 to Sn divided into the n sections by the switching selector 103 by using an n-division clock signal, or after it completes sampling the image signals in one horizontal period.

The image signals S1 to Sn outputted from the switching selector 103 are inputted to one terminal of the plurality of blocks of the image display driver 104, and sequentially shifted to another block. Then, the image display driver 104 samples a pixel data of each block at a predetermined frequency.

The operation of the liquid crystal display apparatus shown in FIG. 7 will be described below with reference to FIGS. 8A to 12.

FIGS. 8A to 8P show averaging patterns generated by the switching controller 102 if the number of signal processors 1 to 2n is 8 (n=4), namely, formats 1 to 8. One table described in each of FIGS. 8A to 8P shows an averaging pattern in one frame. The each of formats 1 to 8 in FIGS. 8A to 8P corresponds to the formats 1 to 8 in FIGS. 2A to 2H, respectively. A horizontal axis indicates an order in a horizontal direction, and a vertical axis indicates an order in a vertical direction. Numerals in the respective tables denote the numbers corresponding to the processed image signals SP1 to SP8 outputted from the selected signal processors 1 to 8. A slant line portion indicates that the processed image signal SP1 outputted from the first signal processor 1 is selected.

Each of FIGS. 9A to 9P shows a display image when the averaging pattern of each of FIGS. 8A to 8P is used. Numerals in respective tables indicate that the image data (processed image signals) SP1 to SP8 processed by the signal processors 1 to 8 corresponding to its number are displayed. A slant line portion indicates a position on the display screen of the image display unit 105 of the processed image signal SP1 processed by the first signal processor 1. A horizontal axis indicates a pixel which is a set of respective dots of R, G and B of the image display unit 105, and a vertical axis indicates a horizontal line.

A first frame (a format 1) of FIG. 9A is exemplified and described. In the first pixel on the first horizontal line, the processed image signal SP1 processed by the first signal processor 1 is indicated as a number [1]. Hereafter, in order from the second pixel to the eighth pixel, the processed image signals SP2 to SP8 processed by the second to eighth signal processors 2 to 8 are indicated as respective numbers [2, 3, 4, 5, 6, 7 and 8].

Similarly, in the first pixel on the second horizontal line, the processed image signal SP3 processed by the third signal processor 3 is indicated as a number [3]. After the first pixel on the second horizontal line, the processed image signals SP4, SP5, SP6, SP7, SP8, SP1 and SP2 are sequentially indicated as numbers [4, 5, 6, 7, 8, 1 and 2]. This case implies that the processed image signal SP1 processed by the first signal processor 1 is indicated in the seventh pixel on the second horizontal line. The procedure after that is same. Thus, its description is omitted.

Here, in the successive eight horizontal lines, it is selected such that the same image data (for example, the processed image signal SP1) is not displayed in a particular pixel (for example, the first pixel). This selecting method is performed on one frame (the successive eight horizontal lines). Thus, in order to uniformly locate the image signals (the processed image signals SP1 to SP8) processed by the 8 signal processors 1 to 8 in all eight pixels on all the eight horizontal lines, 8 frames are needed.

In this embodiment, the switching controller 102 is set at the 2n×2 vertical period and the 2n horizontal period. Thus, as shown in FIGS. 8A to 9P, it is designed such that the same averaging pattern is used in an odd-numbered frame and an even-numbered frame which are adjacent to each other. As shown in FIGS. 8 and 9, one round or cycle of the averaging operation is completed in 16 frames.

Each of FIGS. 10A to 10P shows a display image when a 1.6-times enlarged displaying is performed in the averaging pattern of each of FIGS. 9A to 9P. The 1.6-times enlarged displaying is attained by using the following method. From image data of five lines, each of image data of three lines is displayed as two lines. In each of FIGS. 10A to 10P, from five lines A to E in each of FIGS. 8A to 8P, each of the lines A, B and D is displayed with two lines to thereby carry out the enlarged displaying.

If such enlarged displaying is done, data of one line is enlarged as the two lines. Thus, in the enlarged portion, the averaging pattern is similarly enlarged. Also, in this case, the data is written to the image display unit 105, two times in one horizontal period. Thus, a write time is equal to half the normal time. So, in order to reserve the write time corresponding to the one horizontal period similarly to the normal case, an interlaced scanning is performed on the enlarged result of each of FIGS. 10A to 10P, as shown in each of FIGS. 11A to 11P. A half-tone dot meshing portion indicates a line jumped over in each frame. Even-numbered lines are jumped over in each of the odd-numbered frames, and odd-numbered lines are jumped over in each of even-numbered frames.

As mentioned above, when the 1.6-times enlarged displaying is done in the image display unit 105, the interlaced scanning is carried out for making the write time equal to the normal case that the 1.6-times enlarged displaying is not done.

Next, FIG. 12 is explained. The processed image signal SP1 ([1]) processed by the first signal processor S1 is extracted from the remaining portion that is not jumped over in each of 8 formats in FIGS. 11A to 11P. The FIG. 12 shows the state that in this case, the portions [1] included in the 8 formats are overwritten. As shown in FIG. 12, it is understood that the processed image signal Sp1 processed by the first signal processor 1 is embedded in all pixels in the image display unit 105. This is similar even in a case of taking notice of the other signal processors 2 to 8.

In this way, when the interlaced scanning is performed, a certain line jumped over in a frame having an averaging pattern is not jumped over in another frame having the same averaging pattern. Accordingly, it is possible to perfectly average the characteristic errors of the signal processors in all pixels on one screen. Also, it is possible to obtain the display quality in which a mark pattern having a particular regularity is not displayed.

It will be described below with reference to the first frame in FIG. 11A and the second frame in FIG. 11B. In the first frame in FIG. 11A and the second frame in FIG. 11B, the same averaging pattern described as format 1 is used. The image signal SP1 processed by the first signal processor 1 and inputted to the portions of the first pixel on the second line, the seventh pixel on the fourth line, the sixth pixel on the sixth line, the second pixel on the eighth line, the eighth pixel on the tenth line, and the third pixel on the twelfth line, of the first frame is jumped over not to be displayed on the screen as the result of the interlaced scanning. The above-mentioned portions jumped over in the first frame are displayed by using the second frame having the same averaging pattern as the first frame. The portions jumped over in the second frame are already displayed in the first frame. This is also similar in the third and fourth frames, the fifth and sixth frames, . . . , and the fifteenth and sixteenth frames.

Figure 13:
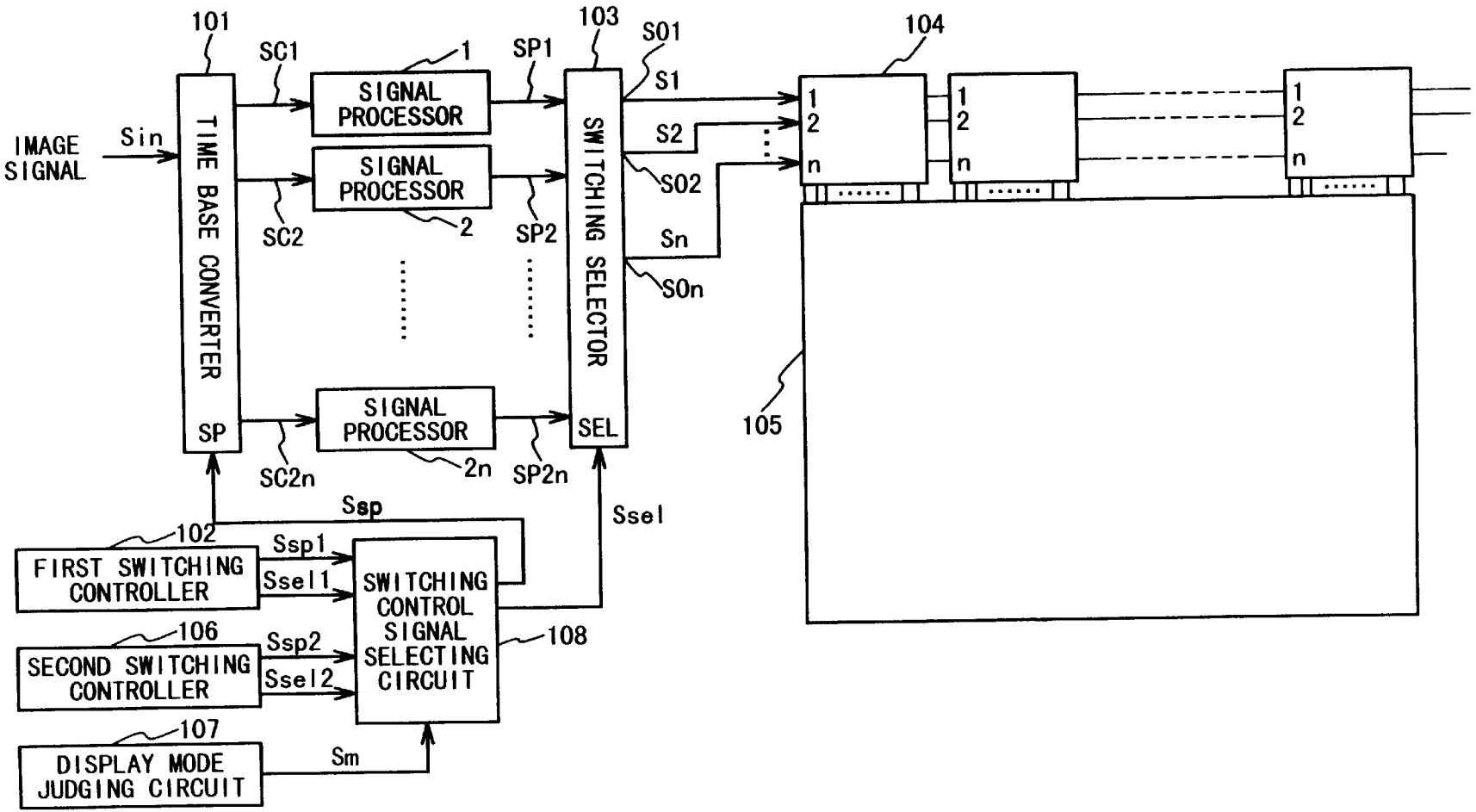
FIG. 13 is a block diagram showing a second embodiment of the present invention.

FIG. 13 is a block diagram showing a second embodiment of the present invention. In this embodiment, its basic configuration is similar to that of the first embodiment. However, its switching control system is further thought out.

As shown in FIG. 13, the second embodiment includes a first switching controller 102, a second switching controller 106, a display mode judging circuit 107 and a switching control signal selecting circuit 108.

In the first switching controller 102, it is set at the 2n horizontal period in the 2n×2 vertical period. The first switching controller 102 is used when the interlaced scanning is done. The second switching controller 106 generates a control signal when the interlaced scanning is not carried out. It is set at the 2n horizontal period in the 2n vertical period.

The display mode judging circuit 107 outputs a judgment output signal Sm indicative of a display mode to the switching control signal selecting circuit 108. The switching control signal selecting circuit 108 selects one of selector signals Ssel1, Ssel2 and one of SP control signals Ssp1, Ssp2 respectively outputted from the first and second switching controllers 102, 106, in accordance with the judgment output signal Sm. The selected SP control signal is inputted to the time base converter 101 as the SP control signal Ssp. The selected selector signal is inputted to the switching selector 103 as the selector signal Ssel to select the its switching period. Since the configurations and the operations of the other sections are similar, their explanations are omitted here.

In the second embodiment, the control signal Ssp1 and the selector signal Ssel1 of the 2n horizontal period in the 2n×2 vertical period of the first switching controller 102 are selected by the display mode judging circuit 107 and the switching control signal selecting circuit 108, if the interlaced scanning is done, for example, when the enlarged displaying is performed. This selection can attain the display quality similar to that of the first embodiment.

If the interlaced scanning is not done, the control signal Ssp2 and the selector signal Ssel2 of the 2n horizontal period in the 2n vertical period of the second switching controller 106 are selected by the display mode judging circuit 107 and the switching control signal selecting circuit 108, if the interlaced scanning is not done. This selection can maintain the display quality similar to that of FIG. 1.

In the explanation of the operation in this embodiment, the case of the eight signal processors is described, namely, the case of n=4 is described. However, of course, n is not limited to this value. Also, of course, the enlargement magnification is not limited to the 1.6-times. Moreover, the input image signal in the present invention may be any of the interlace signal and the progressive signal. So, it may be applied to any signal.

As mentioned above, according to the present invention, in the active matrix type liquid crystal display apparatus, when the interlaced scanning is done to display the image signal by jumping over the horizontal display line every other line, for the enlarged displaying and the like, the same averaging format is used as each of the frame in which the even-numbered lines are jumped over and the frame in which the odd-numbered lines are jumped over. In short, the averaging pattern in which the horizontal lines are jumped over is used for another frame when the different horizontal lines are jumped over, which enables the perfectly averaging operation. Hence, even if the interlaced scanning is done, it is possible to obtain the display quality in which the pattern having the particular regularity, such as the noise in the form of lattice is not displayed.

What is claimed is:

1. A method of driving a display apparatus, comprising:

(a) providing a plurality of processors outputting a plurality of output signals, respectively;

(b) providing a plurality of frames, wherein each of said plurality of frames has an averaging pattern for averaging characteristic errors of said plurality of processors and has a plurality of lines;

(c) performing a first scanning on a predetermined frame of said plurality of frames such that a predetermined line of said plurality of lines of said predetermined frame is not scanned; and (d) performing a second scanning on a specific frame of said plurality of frames such that a line corresponding to said predetermined line of said specific frame is scanned, said specific frame having a same averaging pattern as said averaging pattern of said predetermined frame.

2. A method of driving a display apparatus according to claim 1, further comprising:

(e) performing a third scanning on said predetermined frame such that all lines of said predetermined frame are scanned; and (f) performing a forth scanning on said specific frame such that all lines of said specific frame are scanned, and wherein one of first and second groups is performed selectively, said first group including said (c) and (d) steps and said second group including said (e) and (f) steps.

3. A method of driving a display apparatus according to claim 2, wherein said first group is performed when each of said plurality of frames is displayed to be enlarged such that a single line of said plurality of lines is displayed as said lines of two, and said second group is performed when each of said plurality of frames is displayed not to be enlarged.

4. A method of driving a display apparatus, comprising:

(aa) providing a plurality of processors of M (M is a positive integer) outputting a plurality of output signals of said M, respectively;

(ab) providing a plurality of frames, wherein each of said plurality of frames is formed to be a matrix with a plurality of lines of said M rows and a plurality of pixels of said M columns, and wherein said plurality of output signals of said M are inputted to said plurality of pixels of said M columns on a specific line of said plurality of lines of said M rows, respectively, and are inputted to said plurality of pixels of said M of a specific column of said M columns on said plurality of lines of said M rows, respectively, to generate an averaging pattern in said each frame; and (ac) performing a scanning on a predetermined frame of said plurality of frames such that a predetermined line of said plurality of lines of said predetermined frame is not scanned, and (ad) performing a scanning on a specific frame of said plurality of frames such that a line corresponding to said predetermined line of said specific frame is scanned, said specific frame having a same averaging pattern as said averaging pattern of said predetermined frame.

5. A method of driving a display apparatus according to claim 4, wherein said plurality of output signals of said M are obtained by a result that an image signal is time-base converted to generate a plurality of converted signals of said M and said plurality of converted signals of said M are inputted to said plurality of processors of said M, respectively.

6. A method of driving a display apparatus according to claim 4, wherein each of said plurality of frames is displayed to be enlarged such that a single line of said plurality of lines of said M rows is displayed as said lines of two.

7. A method of driving a display apparatus according to claim 4, wherein said (ab) step includes providing said plurality of frames of double said M which have a plurality of said averaging patterns of said M type.

8. A method of driving a display apparatus according to claim 1, wherein when said (c) step is performed, an even-numbered line as said predetermined line of said predetermined frame is not scanned and an odd-numbered line of said predetermined frame is scanned, and when said (d) step is performed, an odd-numbered line of said specific frame is not scanned and an even-numbered line of said line of said specific frame is scanned.

9. A method of driving a display apparatus according to claim 4, wherein when said pixel of P-th (P is a positive integer) of said plurality of said pixels of said M columns on a predetermined line of said plurality of lines of said M rows inputs said output signal outputted from said processor of Q-th (Q is a positive integer) of said plurality of processors of said M, said pixel of (said P+1)-th of said plurality of said pixels of said M columns on said predetermined line inputs said output signal outputted from said processor of (said Q+1)-th of said plurality of processors of said M.

10. A method of driving a display apparatus according to claim 4, wherein a single cycle of averaging characteristic errors of said plurality of processors of said M consists of said plurality of frames of double said M which have a plurality of said averaging patterns of said M.

11. A display apparatus, comprising:

a display unit displaying an image based on a plurality of frames;

a time base converter dividing an image signal on a time base in response to a first control signal to generate a plurality of converted signals of M (M is a positive integer);

a plurality of processors of said M outputting a plurality of output signals of said M based on said plurality of converted signals of said M, respectively;

a frame generating unit generating said plurality of frames based on said plurality of output signals in response to a second control signal such that each of said plurality of frames has an averaging pattern for averaging characteristic errors of said plurality of processors of said M; and a control circuit generating said first and second control signals such that said time base converter generates said plurality of converted signals of double said M in a single period of said averaging in response to said first control signal, and said frame generating unit generates said plurality of frames of double said M in said single period in response to said second control signal.

12. A display apparatus according to claim 11, wherein said display unit is a liquid crystal display of active matrix type.

13. A display apparatus according to claim 11, wherein said control circuit generates said first control signal such that said time base converter generates said plurality of converted signals of double said M in a vertical period corresponding to (said M×2) and a horizontal period corresponding to said M in response to said first control signal.

14. A display apparatus according to claim 11, wherein said control circuit generates said second control signal such that said frame generating unit generates said plurality of frames of double said M in a vertical period corresponding to (said M×2) and a horizontal period corresponding to said M in response to said second control signal.

15. A display apparatus according to claim 11, wherein a division ratio when said time base converter divides said image signal corresponds to (said M divided by 2).

16. A display apparatus, comprising:

a plurality of processors outputting a plurality of output signals, respectively;

a plurality of frames, wherein each of said plurality of frames has an averaging pattern for averaging characteristic errors of said plurality of processors and has a plurality of lines;

a scanning unit performing a first scanning on a predetermined frame of said plurality of frames such that a predetermined line of said plurality of lines of said predetermined frame is not scanned, and performing a second scanning on a specific frame of said plurality of frames such that a line corresponding to said predetermined line of said specific frame is scanned, said specific frame having a same averaging pattern as said averaging pattern of said predetermined frame.

17. A display apparatus according to claim 16, wherein said scanning unit performs a third scanning on said predetermined frame such that all lines of said predetermined frame are scanned, and performs a forth scanning on said specific frame such that all lines of said specific frame are scanned, and performs one of first and second groups selectively, said first group including said first and second scannings and said second group including said third and fourth scannings.

18. A display apparatus according to claim 17, wherein said scanning unit performs said first group when each of said plurality of frames is displayed to be enlarged such that a single line of said plurality of lines is displayed as said lines of two, and performs said second group when each of said plurality of frames is displayed not to be enlarged.

19. A display apparatus according to claim 16, wherein when said scanning unit performs said first scanning, said scanning unit scans an odd-numbered line of said predetermined frame without scanning an even-numbered line as said predetermined line of said predetermined frame and when said scanning unit performs said second scanning, said scanning unit scans an even-numbered line as said line of said specific frame without scanning an odd-numbered line of said specific frame.

20. A display apparatus, comprising:

a plurality of processors of M (M is a positive integer) outputting a plurality of output signals of said M, respectively;

a frame generating unit generating a plurality of frames, wherein each of said plurality of frames is formed to be a matrix with a plurality of lines of said M rows and a plurality of pixels of said M columns, and wherein said plurality of output signals of said M are inputted to said plurality of pixels of said M columns on a specific line of said plurality of lines of said M rows, respectively, and are inputted to said plurality of pixels of said M of a specific column of said M columns on said plurality of lines of said M rows, respectively, to generate an averaging pattern in said each frame; and a scanning unit performing a first scanning on a predetermined frame of said plurality of frames such that a predetermined line of said plurality of lines of said predetermined frame is not scanned, and performing a second scanning on a specific frame of said plurality of frames such that a line corresponding to said predetermined line of said specific frame is scanned, said specific frame having a same averaging pattern as said averaging pattern of said predetermined frame.

21. A display apparatus according to claim 20, further comprising:

a time base converter time-converting an image signal to generate a plurality of converted signals of said M, and wherein said plurality of processors of said M input said plurality of converted signals of said M to output said plurality of output signals of said M, respectively.

22. A display apparatus according to claim 20, wherein each of said plurality of frames is displayed to be enlarged such that a single line of said plurality of lines of said M rows is displayed as said lines of two.

23. A display apparatus according to claim 20, wherein said frame generating unit generates said plurality of frames of double said M which have a plurality of said averaging patterns of said M type.

24. A display apparatus according to claim 20, wherein when said pixel of P-th (P is a positive integer) of said plurality of said pixels of said M columns on a predetermined line of said plurality of lines of said M rows inputs said output signal outputted from said processor of Q-th (Q is a positive integer) of said plurality of processors of said M, said pixel of (said P+1)-th of said plurality of said pixels of said M columns on said predetermined line inputs said output signal outputted from said processor of (said Q+1)-th of said plurality of processors of said M.

25. A display apparatus according to claim 20, wherein a single cycle of averaging characteristic errors of said plurality of processors of said M consists of said plurality of frames of double said M which have a plurality of said averaging patterns of said M.

26. A computer readable recording medium for recording a program for a process, comprising:

(g) providing a plurality of processors outputting a plurality of output signals, respectively;

(h) providing a plurality of frames, wherein each of said plurality of frames has an averaging pattern for averaging characteristic errors of said plurality of processors and has a plurality of lines;

(i) performing a first scanning on a predetermined frame of said plurality of frames such that a predetermined line of said plurality of lines of said predetermined frame is not scanned; and (j) performing a second scanning on a specific frame of said plurality of frames such that a line corresponding to said predetermined line of said specific frame is scanned, said specific frame having a same averaging pattern as said averaging pattern of said predetermined frame.

* * * * *